US007326129B2

(12) United States Patent
Ninomiya et al.

(10) Patent No.: US 7,326,129 B2
(45) Date of Patent: Feb. 5, 2008

(54) MULTI-PIECE GOLF BALL AND MANUFACTURING METHOD THEREOF

(75) Inventors: Norikazu Ninomiya, Osaka (JP); Kenji Onoda, Kashihara (JP); Masao Ogawa, Osaka (JP); Yuri Naka, Katano (JP)

(73) Assignee: Mizuno Corporation, Osaka-shi (JP)

( * ) Notice: Subject to any disclaimer, the term of this patent is extended or adjusted under 35 U.S.C. 154(b) by 141 days.

(21) Appl. No.: 11/081,733

(22) Filed: Mar. 17, 2005

(65) Prior Publication Data

US 2005/0255944 A1 Nov. 17, 2005

(30) Foreign Application Priority Data

Mar. 19, 2004 (JP) ..... 2004-081713
Jun. 29, 2004 (JP) ..... 2004-191415

(51) Int. Cl.
*A63B 37/06* (2006.01)

(52) U.S. Cl. ..... 473/377

(58) Field of Classification Search ..... 473/374, 473/373, 377, 376

See application file for complete search history.

(56) References Cited

U.S. PATENT DOCUMENTS

| | | | | |
|---|---|---|---|---|
| 698,516 | A | 4/1902 | Kepmshall | |
| 4,173,345 | A | 11/1979 | Pocklington | 273/217 |
| 4,229,401 | A | 10/1980 | Pocklington | 264/248 |
| 4,660,830 | A | 4/1987 | Tomar | 273/60 |
| 5,692,973 | A | 12/1997 | Dalton | 473/374 |
| 5,820,485 | A | 10/1998 | Hwang | 473/361 |
| 5,836,834 | A * | 11/1998 | Masutani et al. | 473/374 |
| 5,984,807 | A | 11/1999 | Wai et al. | 473/376 |
| 6,004,226 | A | 12/1999 | Asakura | 473/373 |
| 6,039,910 | A | 3/2000 | Tanaka et al. | 264/248 |
| 6,126,560 | A | 10/2000 | Maruoka et al. | 473/409 |
| 6,155,935 | A | 12/2000 | Maruko | 473/361 |
| 6,213,893 | B1 | 4/2001 | Maruko et al. | 473/370 |
| 6,217,462 | B1 | 4/2001 | Maruko et al. | 473/370 |
| 6,293,877 | B1 | 9/2001 | Boehm | 473/371 |
| 6,296,578 | B1 | 10/2001 | Masutani | 473/368 |
| 6,398,667 | B1 | 6/2002 | Lemons | 473/374 |
| 6,485,378 | B1 * | 11/2002 | Boehm | 473/374 |
| 6,835,146 | B2 | 12/2004 | Jordan et al. | 473/377 |
| 6,955,613 | B2 * | 10/2005 | Ninomiya et al. | 473/367 |
| 7,169,065 | B2 * | 1/2007 | Ninomiya et al. | 473/370 |

(Continued)

FOREIGN PATENT DOCUMENTS

JP 40-3456 1/1965

(Continued)

OTHER PUBLICATIONS

International Search Report dated May 31, 2005.

*Primary Examiner*—Raeann Trimiew
(74) *Attorney, Agent, or Firm*—Kratz, Quintos & Hanson, LLP

(57) ABSTRACT

A multi-piece golf ball has a core 3, an interlayer 5, and a cover 7, the core 3 having a spherical main part 9 and a plurality of ribs 11 provided on the surface of the main part 9, the interlayer 5 being inserted into depressions surrounded by the ribs 11, and the hardness of the interlayer 5 being less than that of the core 3. The multi-piece golf ball can achieve an especially long carry distance.

23 Claims, 21 Drawing Sheets

U.S. PATENT DOCUMENTS

| | | | | |
|---|---|---|---|---|
| 7,192,367 | B2 * | 3/2007 | Ninomiya et al. | 473/374 |
| 2002/0016225 | A1 | 2/2002 | Maruko et al. | 473/377 |
| 2003/0083153 | A1 | 5/2003 | Sullivan et al. | 473/351 |
| 2004/0138006 | A1 | 7/2004 | Ninomiya et al. | 473/370 |
| 2004/0254031 | A1 * | 12/2004 | Ninomiya et al. | 473/371 |
| 2006/0058117 | A1 * | 3/2006 | Ninomiya et al. | 473/355 |

FOREIGN PATENT DOCUMENTS

| | | |
|---|---|---|
| JP | 49-136364 | 11/1974 |
| JP | 60-241463 | 11/1985 |
| JP | 62-73932 | 4/1987 |
| JP | 62-270178 | 11/1987 |
| JP | 10-337340 | 12/1998 |
| JP | 2000-84120 | 3/2000 |
| JP | 2000-288122 | 10/2000 |
| JP | 2001-112889 | 4/2001 |
| JP | 2001-112890 | 4/2001 |
| JP | 2001-340493 | 12/2001 |
| JP | 2004-41743 | 2/2004 |
| WO | WO 2004/087265 A1 | 10/2004 |

* cited by examiner (a)

(b)

(a)

(b)

(a)

(b)

(a)

(b)

(a)

(b)

(c)

(a)

(b)

(a)

(b)

MULTI-PIECE GOLF BALL AND MANUFACTURING METHOD THEREOF

TECHNICAL FIELD

The present invention relates to a multi-piece golf ball comprising a plurality of layers, and a manufacturing method thereof.

BACKGROUND OF THE INVENTION

Recently, several kinds of golf balls exhibiting both high bounce resilience and a soft feel when hit have been proposed. One example of such a golf ball is a multi-piece golf ball in which the ball is composed of a plurality of layers. Generally, in a multi-layered golf ball, especially in a golf ball that has three or more layers, a highly rigid core is covered with an interlayer that has relatively low rigidity, and the outer surface of the interlayer is covered with a hard cover. This arrangement aims to attain both high bounce resilience and a soft feel when hit by using the rigidity of the core and the softness of the interlayer. One example of such a multi-piece golf ball is disclosed in Japanese Examined Patent Publication No. 1991-52310.

However, such heretofore-known multi-layered golf balls aim to achieve both a long carry distance attained by the high bounce resilience property and a soft feeling when hit, which are inherently conflicting properties. Therefore, their performance in terms of carry distance may be unsatisfactory and there is room for further improvement.

SUMMARY OF THE INVENTION

One object of the present invention is to provide a multi-piece golf ball that can achieve a longer carry distance than heretofore-known golf balls, and a manufacturing method thereof.

The multi-piece golf ball of the present invention comprises a core, an interlayer, and a cover. The multi-piece golf ball aims to solve the above-descried problem. The core comprises a spherical main part and a plurality of ribs provided on the surface of the main part, the interlayer is inserted into depressions surrounded by the ribs, and the hardness of the interlayer is greater than that of the ribs.

In this arrangement, because the hardness of the interlayer is greater than that of the ribs, an excellent resilience property can be obtained, and even if the club head speed is slow, a satisfactory carry distance can be achieved. Furthermore, the following effects can be attained. When a golf club comes into contact with a golf ball, usually the ball is deformed in the circumferential direction due to friction generated between the ball and the clubface. When the deformed ball returns to its original condition due to elastic resistance, a force in the direction opposite to the direction of backspin is applied to the ball. At this moment, the greater the deformation of the deformed ball, the more the backspin is suppressed, and the longer carry distance can be achieved.

In the golf ball of the present invention, the ribs enhance the elastic resistance, which is the force applied when the ball is returning to its original condition, and therefore the backspin can be effectively reduced. More specifically, in this golf ball, because the hardness of the ribs is less than that of the interlayer, the ribs deform to a greater degree than the interlayer. The ribs are not mere protrusions but are structured so as to form walls surrounding the interlayer, and therefore when the ribs are returning to their original condition, the force of the entire wall strongly acts on the interlayer from the perimeter of the interlayer, and this increases the force opposing the backspin. As a result, a significantly longer carry distance can be achieved. This effect is particularly remarkable when the ball is hit by drivers, etc., which are designed to attain a long carry distance.

When an iron, in particular a short iron, is used, the striking direction is mainly in the direction tangential to the ball, and therefore a force in the circumferential direction acts on the ball. Therefore, the deformation of the interlayer in the circumferential direction is absorbed by the low-hardness ribs. As a result, when an iron is used, a soft feeling when hit can be obtained.

In the golf ball of the present invention, the core can be easily manufactured by molding the main part and ribs as a unit.

In the golf ball of the present invention, it is possible to make the hardness of the main part the same as the ribs. In this structure, because the hardness of the interlayer is greater than not only the ribs but also the main part, it is possible to reduce the amount of spin, and therefore attain an enhanced carry distance. Furthermore, when a ball is hit by an iron, since the force applied to the ball more effectively acts on the ribs and main part than on the interlayer, because they are softer than the interlayer, the soft feeling when hit can be enhanced.

In the golf ball of the present invention, it is also possible to make the hardness of the main part less than that of the ribs. In this structure, when a driver is used, because excess spin can be easily suppressed, it is possible to increase the launch angle and obtain a longer carry distance.

In the golf ball of the present invention, it is further possible to make the hardness of the main part greater than that of the interlayer. In this structure, the bounce resilience of the ball is enhanced by increasing the hardness of the main part, and accordingly the carry distance can be increased.

In the golf ball of the present invention, it is yet further possible to make the hardness of the main part greater than that of the ribs but less than that of the interlayer. In this structure, by suitably selecting the spin amount and resilience property in accordance with the head speed, etc., it is possible to increase the carry distance.

In the above-described structure of a golf ball, the height of each rib as measured from the surface of the main part is preferably 2.0 to 11.0 mm, and more preferably 5.0 to 10.5 mm. When the rib height is greater than 2.0 mm, the thickness of the interlayer of high hardness is prevented from becoming too thin, and a satisfactory resilience property can be maintained. When the rib height is less than 11.0 mm, the thickness of the interlayer is prevented from becoming too thick, which would otherwise cause a hard feeling when hit.

In the above-described golf ball, various rib structure configurations are possible. In order to obtain a long carry distance by having tall ribs, the height of each rib, measured from the surface of the main part, is preferably 6.4 to 11.0 mm, and more preferably 8.0 to 10.5 mm. In this case, it is preferable that each rib extend in such a manner that its width increases from the cover to the core, and that depressions be formed into cone-like shapes by the side faces of the ribs. In this structure, because the width of each rib is greater at the base than the top, it is possible to prevent the rib from collapsing when pressure is applied during molding. In particular, this structure is advantageous in the present invention because the hardness of the ribs is low.

In this structure, the proportion held by the interlayer gradually decreases towards the center of the ball, and accordingly the proportion held by the low-hardness ribs increases. Therefore, the influence of impact is lessened towards the center of the ball; however, because the proportion held by the low-hardness ribs increases, deformation of the ribs can be ensured. As a result, the taller the ribs become, the greater the force reducing the backspin should be, further increasing the carry distance.

In the present invention, "cone-like shape" refers to a shape such that each depression forms a somewhat conical region by being surrounded by rib side faces, and the area of a plane formed by cutting the region along a spherical surface having the same central point as the core decreases as the cutting surface moves from the cover to the core. The shape of the above-described plane is not limited and may be, e.g., polygonal as well as circular. In some embodiments, the depression is formed into a cone-like shape by being surrounded only by ribs, while in other embodiments, the main body is exposed at the bottom of the depression, and the side faces of the ribs and the main body together define the cone-like shape. However, even when the main body is exposed, the exposed area thereof is small and a cone-like shape is formed as a whole.

When the height of the ribs is increased, the diameter of the main part becomes smaller. This makes it easier to mold the core. In other words, in prior-art golf balls, if the diameter of the core is large, when the core is formed from, for example, a rubber composition, it is difficult to satisfactorily vulcanize the center thereof, and this varies the hardness of the core along the radial direction. In contrast, if the diameter of the main part of the core is relatively small as described above, it is possible to satisfactorily vulcanize the center of the core, and therefore a core having a uniform hardness can be obtained.

In the above-described golf ball, it is also possible to arrange the ribs such that each of the ribs comprises at least one notch so as to form a passageway between adjacent depressions. Forming notches in the ribs has the following advantages during manufacturing. For example, when a golf ball of the present invention is manufactured by molding a core, placing it in a mold together with a material for the interlayer, and press molding, because the adjacent depressions communicate with each other via the notches, when press molding is conducted, the material for the interlayer spreads throughout the depressions through the notches. This makes it unnecessary to separately insert the material for the interlayer into each of the depressions, simplifying the manufacturing equipment and reducing the manufacturing time. When the interlayer is formed by injection molding, the interlayer can be formed by using one or a small number of gates, thus reducing the production equipment cost.

It is preferable that the ribs extend along three great circles on the surface of the main part, intersecting each other at right angles, that each arc section partitioned by the intersections of the great circles is provided with at least one notch, that each notch has a plane extending along the arc section from one point on a normal line on the core that passes through the intersection of the great circle, and that the plane has an angle not smaller than 90° relative to the normal line. Four depressions that are arranged so as to have their common center at an intersection of the great circles are thus made to communicate with each other, and the material for the interlayer can readily spread between them. Because the angle made between the plane and the normal line is not smaller than 90°, the angle serves as a draft angle, and, for example, when the core is molded using two molds, such as an upper mold and a lower mold, the core can be easily removed from the mold.

From the viewpoint of making adjacent depressions communicate with each other, it is possible to form a notch in the middle of the arc section in the arc direction. It is preferable that such a notch have two planes that both extend toward the intersection from a point on the normal line of the spherical body that passes through the mid point of each arc section in the arc direction, wherein the angle made between the planes and the normal line is 45 to 48°. This arrangement allows the above angle made between the planes and the normal line to serve as a draft angle, so that the core can be removed from the mold easily.

In the present invention, by shaping the ribs as described above, even when the core is molded using two molds, the core can be easily removed from the mold. In other words, if a protrusion is simply formed, the protrusion may snag, thus preventing the core from being removed from the mold and making manufacturing impossible. However, by arranging the ribs as described above, even if a protrusion is formed on the main part, the core can be easily removed from the mold. As a result, productivity can be improved.

To solve the above-described problem, a method for manufacturing a multi-piece golf ball of the present invention having a core, an interlayer, and a cover comprises the steps of preparing a first mold that comprises a base having a spherical surface, and a cavity having a plurality of grooves formed along the surface of the base, the grooves being substantially the same depth as each other as measured from the surface; molding a core having a plurality of ribs on the surface of a spherical main part by inserting a core material into the cavity of the first mold; preparing a second mold having a spherical cavity corresponding to the outermost diameter of the core; molding an interlayer whose hardness is greater than that of the core by placing the core taken from the first mold in the cavity of the second mold, and inserting an interlayer material into depressions surrounded by the ribs; and molding a cover over the second interlayer.

By employing this manufacturing method, it is possible to obtain a multi-piece golf ball that can achieve a greatly increased carry distance as described above. In the second mold, because the cavity corresponds to the outermost diameter of the core, it is possible to insert an interlayer material with the ribs in contact with the surface of the cavity. Therefore, the core can be easily centered, and this makes it possible to accurately align the center of each layer.

The above-described manufacturing method explains one embodiment wherein the main part and the ribs are molded as a unit. This arrangement allows the hardness of the main part to be substantially the same as that of the ribs. In contrast, a golf ball in which the hardness of the main part differs from that of the ribs can be manufactured by the following method. In other words, one of the other methods for manufacturing a multi-piece golf ball of the present invention having a core, an interlayer, and a cover that solves the above-described problem comprises the steps of molding a spherical main part; preparing a first mold comprising a cavity having a spherical receiving part that corresponds to the surface of the main part and a plurality of grooves formed along the surface of the receiving part, the grooves being substantially the same depth as measured from the surface; molding the core having a plurality of ribs on the surface of the main part by placing the main part in the receiving part of the first mold and inserting a material having a hardness different from that of the main part into the cavity; preparing a second mold having a spherical cavity corresponding to the outermost diameter of the first interlayer; molding an interlayer whose hardness is greater than that of the core by placing the core taken from the first mold in the cavity of the second mold, and inserting a material having a hardness different form that of the ribs into a depressions surrounded by the ribs; and molding a cover over the interlayer.

In the above-described manufacturing method, a core comprising a spherical main part and ribs provided on the surface of the main part are molded. In the first mold, if the depth of each groove measured from the base is 6.4 to 11.0 mm, it is possible to manufacture a golf ball having a suitable bounce resilience property because the hard interlayer is relatively thick. When the core comprises a rubber composition, and the diameter of the main part is relatively small, it is possible to satisfactorily vulcanize the core, including around the center thereof, and to mold a core with little variation in hardness without decreasing its hardness near the center.

By arranging the cavity of the first mold so that a plurality of grooves communicate with one other to form at least one enclosed region, and so that at least one shallower portion is formed in the grooves, notches as described above can be formed in the ribs. This allows the material for the interlayer to spread throughout the depressions in the interlayer molding step.

BRIEF DESCRIPTION OF THE DRAWINGS

FIG. 14 shows perspective views of the golf ball of FIG. 13 wherein FIG. 14A shows the core and FIG. 14B shows a semifinished product comprising the core and an interlayer.

BEST MODE FOR CARRYING OUT THE INVENTION

First Embodiment

Figure 1:
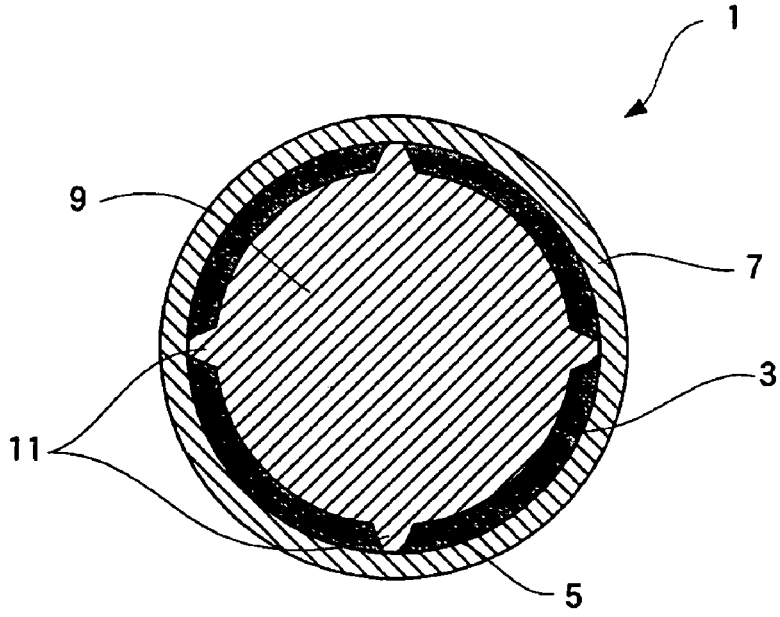
FIG. 1 is a cross-sectional view showing a golf ball of a first embodiment of the present invention.

Hereunder, a multi-piece golf ball of a first embodiment of the present invention is explained with reference to drawings. FIG. 1 is a cross-sectional view of a golf ball of the present embodiment.

As shown in FIG. 1, the golf ball 1 of the present embodiment is a so-called three-piece golf ball wherein a core 3 is covered with an interlayer 5 and a cover 7. According to the rules (see R&A and USGA), the diameter of a golf ball must be no smaller than 42.67 mm. However, taking aerodynamic characteristics and the like into consideration, it is preferable that the diameter of the ball be as small as possible. Therefore, it can be, for example, 42.7 to 43.7 mm.

Figure 2:
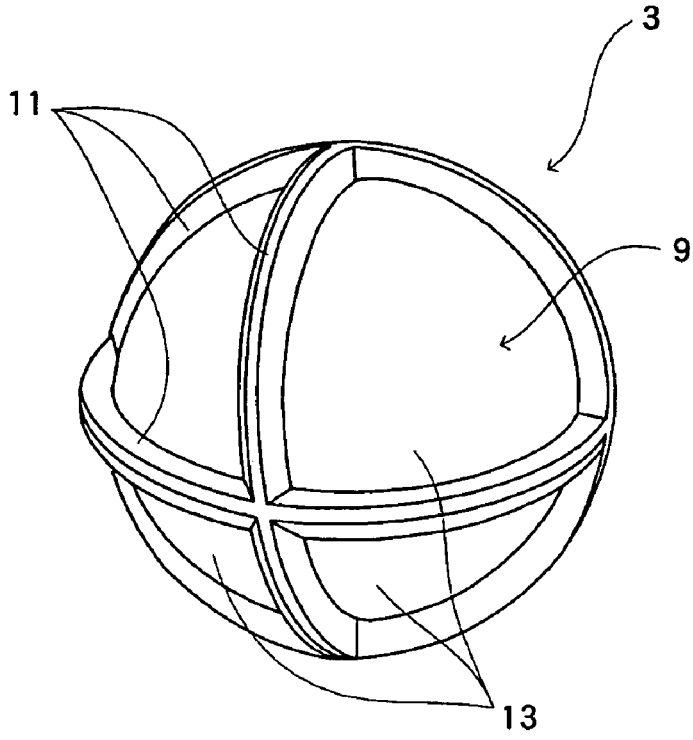
FIG. 2 is a perspective view of the core of the golf ball of FIG. 1.

The core 3 is composed of a rubber composition, and, as shown in FIG. 2, comprises a spherical main part 9 and three ribs (protrusions) 11 molded as a unit on the surface of the spherical main part 9. Each rib 11 extends along one of three great circles drawn around the main part 9 so as to intersect each other at right angles. These ribs form eight depressions 13 on the surface of the main part 9.

It is preferable that the diameter of the main part 9 be 15.4 to 37.3 mm, and that the height of the rib 11 be 2.0 to 11.0 mm. To obtain a soft feeling when hit, the Shore D hardness of the core 3 is preferably 38 to 58, and more preferably 42 to 48.

Figure 3:
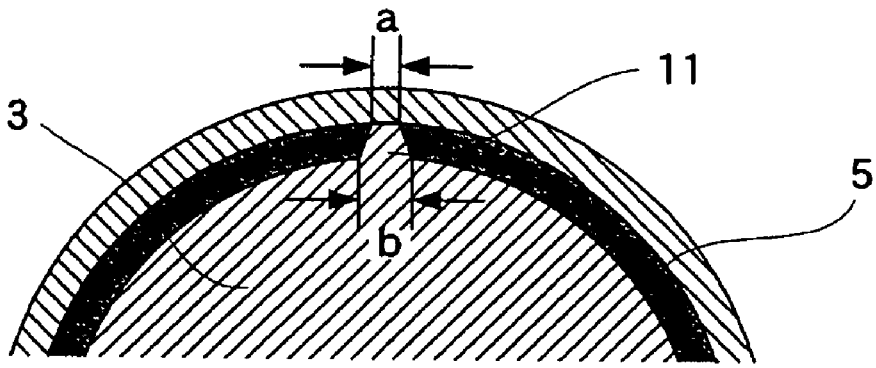
FIG. 3 is an expanded sectional view of the golf ball of FIG. 1.

As shown in FIG. 3, each rib 11 is structured so as to have a trapezoidal profile in its sideways cross-section in such a manner that its width increases as it approaches the main part 9. It is preferable that the width of the top portion a of each rib in the outward radial direction be 1.5 to 3.0 mm and that the width of the bottom portion b in the inward radial direction be 3.0 to 12.0 mm. The widths of the end portions of the rib 11 may be set outside this range; however, by setting a lower limit for the width of each end portion of the rib 11, it is possible to prevent the rib 11 from being deformed by the pressure of filling the interlayer 5 that results from tightly closing the mold when filling the material for the interlayer 5 during the manufacturing process. As a result, it is possible to accurately hold the core 9 in the center of the mold. Furthermore, by setting an upper limit for the width of each end portion of the rib 11 as described above, it is possible to prevent areas where the low-hardness rib 11 and inner surface of the cover 7 are attached to each other from becoming unduly large, and this enables an adequately soft feel when hitting the ball. Note that it is preferable that the widths of the end portions a and b become greater as the height of the rib 11 is increased. For example, when the height of the rib 11 is 4.6 mm, the width of the end portion b can be 6.0 mm.

The interlayer 5 is composed of a rubber composition or an elastomer, covers the surface of the core 3, and its outline forms a substantially spherical shape. As shown in FIG. 1, the interlayer 5 has almost the same thickness as the height of the ribs 11, and is injected into each of the eight depressions 13 surrounded by the ribs 11. The top portions of the ribs 11 are exposed through the surface of the interlayer 5. To increase the resilience property, it is necessary to make the hardness of the interlayer 5 greater than that of the core 3. The Shore D hardness of the interlayer 5 is preferably 48 to 66, and more preferably 50 to 56. In this structure, the Shore D hardness of the interlayer 5 is greater than that of the core 3 preferably by 2 to 10, and more preferably 4 to 6. The variance in the hardness between the interlayer 5 and the core 3 may be set outside this range. However, the reason for setting it in this range is that if the variance in hardness between the core and interlayer is unduly large and the hardness of the interlayer is unexpectedly great, the hardness of the interlayer becomes notable and this hardens the impact feel. In contrast, if the variance in hardness is unduly small, the degree of deformation of the core relative to the interlayer becomes too small, and this reduces the effect of the force applied in the direction opposite to the backspin direction, which will be described below.

The cover 7 is composed of an elastomer, and covers the top portions of the ribs 11 and the interlayer 5, with predetermined dimples (not shown) being formed on the outer surface of the cover 7. It is preferable that the thickness of the cover 7 be 0.8 to 2.6 mm, and more preferably 1.6 to 2.0 mm. The thickness of the cover 7 may be set outside this range; however, if the thickness of the cover 7 is less than 0.8 mm, the durability of the cover decreases remarkably and molding becomes difficult. On the other hand, if it exceeds 2.6 mm, the impact feel becomes too hard. It is preferable that its Shore D hardness be 56 to 68. Note that the thickness of the cover 7 is defined as the distance from an arbitrary point on the outermost part in the outward radial direction where no dimple is formed to an arbitrary point that comes into contact with the interlayer that is measured along the normal line.

The materials constituting the components of the above-described golf ball are explained in detail. The core 3 can be manufactured using a known rubber composition comprising a base rubber, a cross-linking agent, an unsaturated carboxylic acid metal salt, a filler, etc. Specific examples of the base rubber include natural rubber, polyisobutylene rubber, styrenebutadiene rubber, EPDM, etc. Among these, it is preferable to use high-cis polybutadiene that contains 40% or more, and preferably 80% or more cis-1,4-bonds.

Specific examples of cross-linking agents include dicumyl peroxide, t-butylperoxide, and like organic peroxides; however, it is particularly preferable to use dicumyl peroxide. The compounding ratio of the cross-linking agent is generally 0.3 to 5 parts by weight, and preferably 0.5 to 2 parts by weight per 100 parts by weight of the base rubber.

As metal salts of unsaturated carboxylic acids, it is preferable to use monovalent or bivalent metal salts of acrylic acid, methacrylic acid, and like $C_3$ to $C_8$ unsaturated carboxylic acids. Among these, the use of zinc acrylate can improve the ball bounce resilience and is particularly preferable. The compounding ratio of the unsaturated carboxylic acid metal salt is preferably 10 to 40 parts by weight per 100 parts by weight of base rubber. This is because, a compounding ratio of less than 10 parts by weight will decrease the ball bounce resilience and shorten the carry distance. If the compounding ratio exceeds 40 parts by weight, the ball becomes too hard and the soft feeling is deteriorated.

Examples of the filler include those generally added to cores. Specific examples thereof include zinc oxide, barium sulfate, calcium carbonate, etc. The preferable compounding ratio of the filler is 2 to 50 parts by weight per 100 parts by weight of base rubber. If necessary, it is also possible to add an antioxidant, a peptizer, and the like.

The interlayer 5 is composed of a rubber composition or elastomer as described above. When a rubber composition is used, the same materials as used for the core 3 described above can be used. However, it is preferable that the compounding ratio of unsaturated carboxylic acids be increased to make the interlayer harder than the core 3.

When the interlayer 5 is composed of an elastomer, it is possible to use, for example, a styrene/butadiene/styrene block copolymer (SBS), a styrene/isoprene/styrene block copolymer (SIS), a styrene/ethylene/butylene/styrene block copolymer (SEBS), a styrene/ethylene/propylene/styrene block copolymer (SEPS), or like styrene-based thermoplastic elastomer; an olefin-based thermoplastic elastomer having polyethylene or polypropylene as a hard segment and butadiene rubber, acrylonitrile butadiene rubber or ethylene/propylene rubber as a soft segment; a vinyl chloride-based plastic elastomer having crystallized poly(vinyl chloride) as a hard segment and amorphous poly(vinyl chloride) or an acrylonitrile butadiene rubber as a soft segment; a urethane-based plastic elastomer having polyurethane as a hard segment and polyether or polyester urethane as a soft segment; a polyester based plastic elastomer having polyester as a hard segment and polyether or polyester as a soft segment; an amide based plastic elastomer having polyamide as a hard segment and polyether or polyester as a soft segment; an ionomer resin, etc.

It is possible to form the cover 7 using an elastomer having almost the same components as those used for the interlayer.

As described above, in the present embodiment, because the interlayer 5 is injected into a depressions 13 surrounded by the ribs 11, in the place where the interlayer 5 contacts the inner surface of the cover 7, the proportion of the interlayer 5 is greater than that of the ribs 11. Therefore, when a ball is hit, most of the striking force acts on the harder interlayer 5. This makes it possible to obtain high bounce resilience property even with a low head speed, and increase the carry distance. Having the above-described structure also has the following advantage. When a golf club hits a golf ball, the ball is usually twisted in the circumferential direction dues to the friction between the ball and the clubface. When the twisted ball returns to its original condition due to elastic resistance, a force opposite to the backspin is applied to the ball. At this moment, the greater the deformation of the twisted ball is, the more the backspin is suppressed, and the longer the carry distance is.

Figure 4:
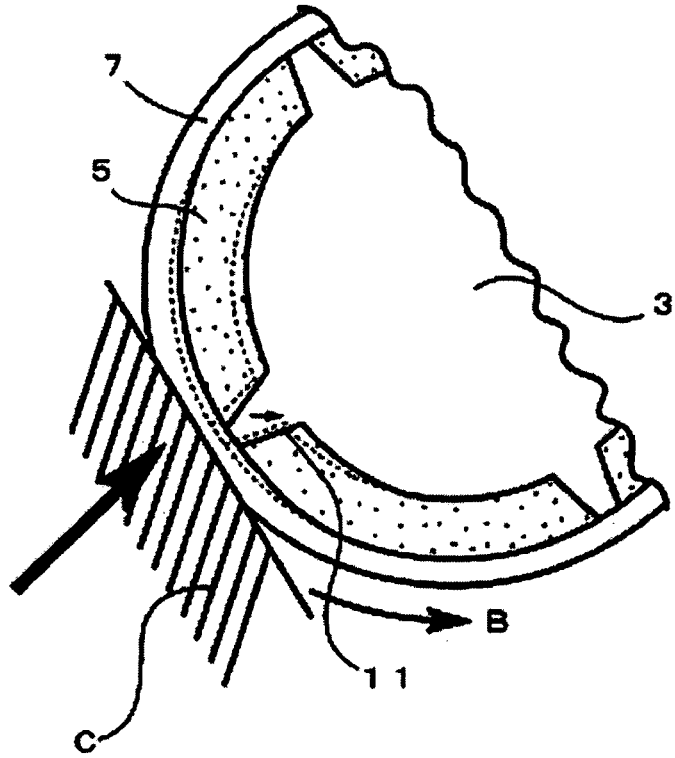
FIG. 4 shows cross-sectional views indicating the condition of the golf ball of FIG. 1 when hit.
Figure 4:
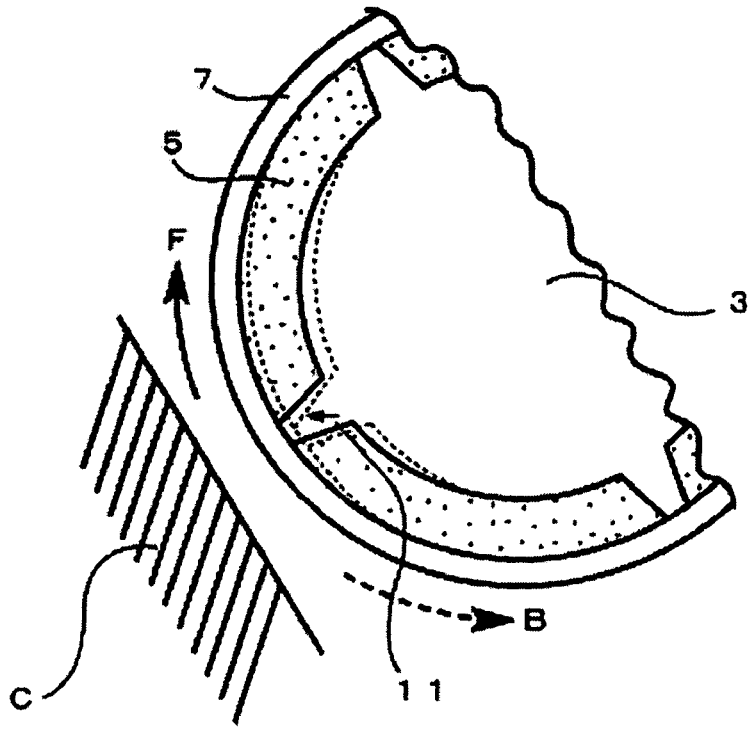

In the golf ball of the present embodiment, the backspin can be effectively reduced because the ribs 11 enhance the elastic resistance, which is a force applied when a ball is returning to its original condition. More specifically, as shown in FIG. 4A, in this golf ball, because the hardness of the rib 11 is less than that of the interlayer 5, when the ball is hit by a club C, the ribs 11 deform more severely than the interlayer 5. Due to the impact, a force causing backspin B is applied to the ball. When the ball separates from the club C, as shown in FIG. 4B, the low-hardness rib 11 returns to its original condition from the deformed condition, and this restoration applies a force to the ball in the direction opposite to the backspin B. As a result, the spin amount is reduced and the launch angle is increased, and therefore a longer carry distance is attained. In particular, in the present embodiment, the ribs are not simple protrusions but are structured so as to form walls surrounding the interlayer, and therefore when the ribs are returning to their original condition, the force of the entire wall greatly acts on the interlayer from the perimeter of the interlayer, and this increases the force F opposite to the backspin B. As a result, the amount of backspin is reduced and a significantly longer carry distance is achieved. This effect is particularly remarkable when the ball is hit by a driver, etc., which is designed to obtain a long carry distance. In FIG. 4, the current condition is shown by solid lines and the condition immediately before the current condition is shown by dashed lines.

Figure 5:
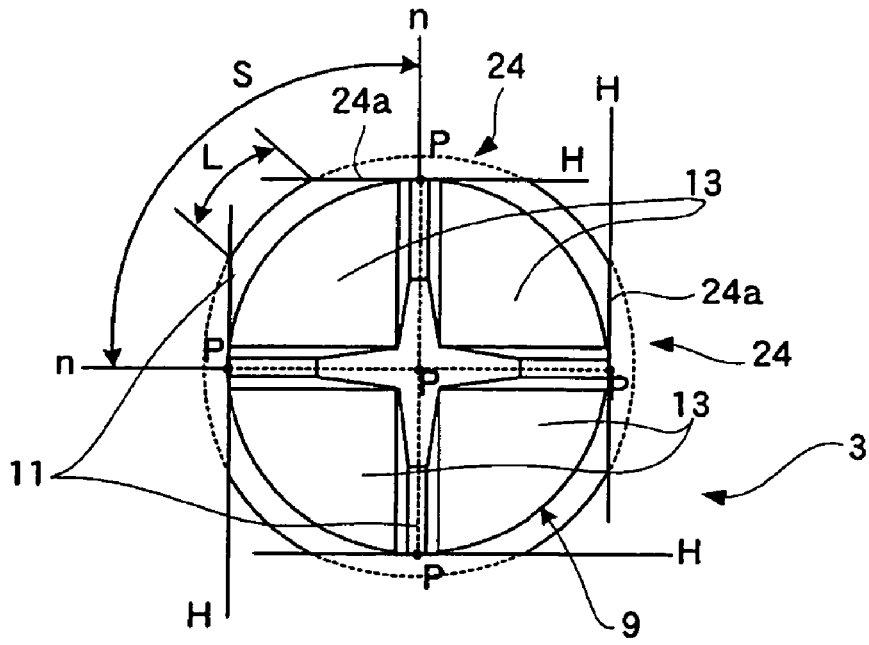
FIG. 5 is a cross-sectional view showing another example of the core of the golf ball of FIG. 1.
Figure 6:
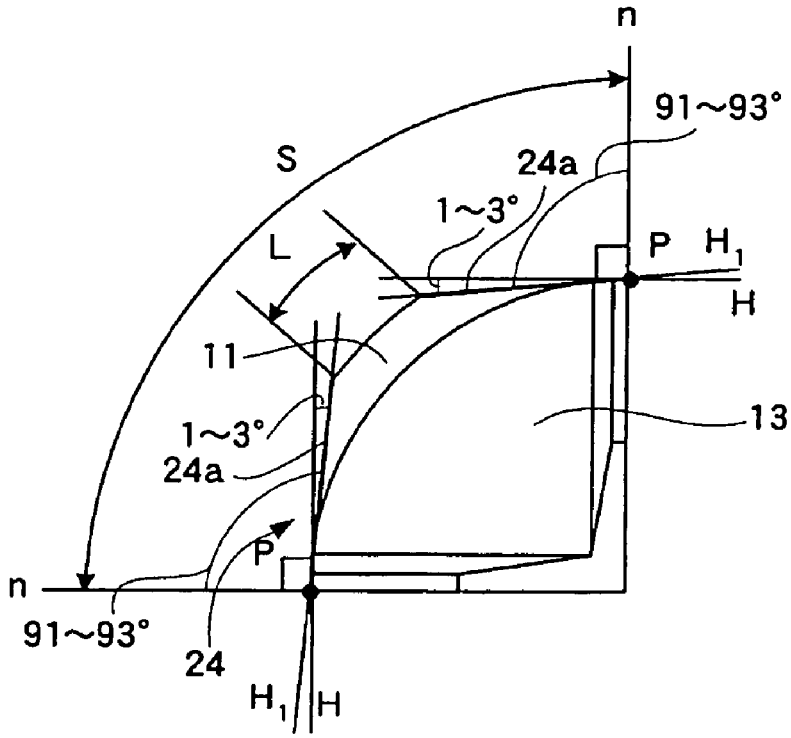
FIG. 6 is a cross-sectional view showing another example of the core of the golf ball of FIG. 1.

The above-described ribs may be formed into various shapes; however, from the viewpoint of effectively molding the interlayer, it is preferable to provide a notch in the rib having a structure as described below. As shown in FIG. 5, the notch 24 is structured so as to have a bottom surface 24*a* extending along a plane H perpendicular to the normal line of the core that passes through the intersection P of the great circles. In other words, the notch 24 is formed by excising the rib 11 at the plane H. By forming notches 24 in this manner, four depressions 13 that are arranged so as to have a common center at an intersection P of the great circles are made to communicate with each other, and the material for the interlayer can readily spread between the depressions 13 via the notches 24. In this case, as shown in FIG. 6, it is also possible to form the bottom surface 24*a* of the notch 24 along a plane $H_1$ that extends away from the plane H by being slanted toward the center of the rib 11 by 1 to 3°, i.e., a plane having an angle made between the normal line n of the main part 9 passing the intersection P is 91 to 93° as viewed from the front. This arrangement enables the angle to serve as a draft, and, for example, when a core is molded using two molds, such as an upper mold and a lower mold, the core 3 can be easily removed from the mold.

When the notch 24 is formed as described above, it is preferable that the length of the notchless top portion of each arc section S of the ribs in the arc direction, divided at the intersection P, as shown in FIG. 5, be not smaller than 10 mm.

Figure 7:
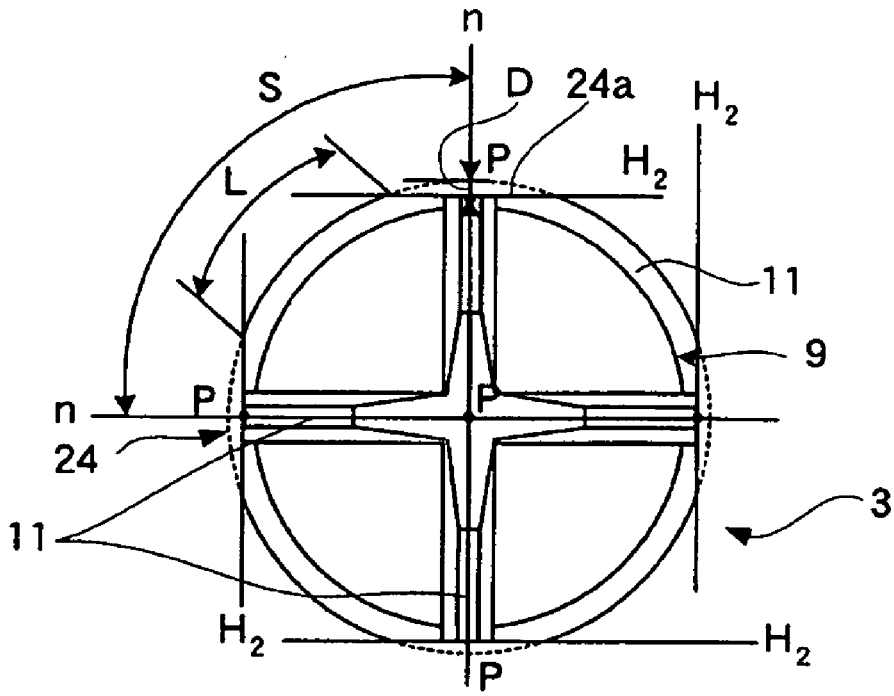
FIG. 7 is a cross-sectional view showing another example of the core of the golf ball of FIG. 1.

As shown in FIG. 7, it is also possible to form a notch 24 so as to have a bottom surface 24*a* extending along a plane $H_2$ that is perpendicular to the normal line of the core and that passes through the mid point in the height direction of the rib 11. In this case, it is preferable that the distance D from the top portion of the virtual rib 11 without a notch 24 to the bottom surface 24*a* be not less than 1.2 mm. The length L should be preferably not less than 10 mm, as in the above-described case. Furthermore, it is also possible to form a draft angle by forming the bottom surface 24*a* of the notch 24 along a plane which has an angle of 91 to 93° relative to the normal line n in the same manner as shown in FIG. 6.

It is also possible to provide a notch in the middle of the arc section S of the rib 11 in the arc direction. As shown in FIG. 8A, it is also possible to form the notch 25 so as to have two bottom surfaces 25*a* each extends toward the intersection P from a point on the normal line m of the main body 9 that passes through the mid point Q of each arc section in the circumferential direction. In this case, it is preferable that the angle made between the bottom surfaces 25*a* and the normal line be 45 to 48° as viewed from the front. This arrangement makes it possible to remove the core 3 from the mold easily. However, if this angle exceeds 48°, the above-described length L of the rib in the circumferential direction becomes unduly short. It is preferable that the depth D of the notch 25 be not less than 1.2 mm. The depth D may be set outside of this range; however, by setting the depth D in this range, it is possible to smoothly spread the interlayer material throughout the depressions 13. Note that the depth D of the notch 25 is defined as the length from the top of the virtual rib 11 without a notch 25 to the deepest portion of the notch 25.

Alternatively, as shown in FIG. 8B, it is also possible to structure the notch 25 so as to have two side surfaces 25*b* each extending in the direction of the intersection P from a point Q on a normal line m of the main part 9 that passes through the mid point of each arc section S in the arc direction, and a bottom surface 25*c* of an arc shape along the main part 9 connecting the two side surfaces 25*b*. In this case, as in the case shown in FIG. 8A, taking the draft angle into consideration, it is preferable that the angle between the side surface 25*b* and the normal line m be 45 to 48° as viewed from the front. Note that it is also possible to form the bottom surface 25*c* so as to pass through the mid point in the height direction of the rib 11. Also in this case, it is preferable that the depth D of the notch be not less than 1.2 mm. As long as the smooth removal of the core is ensured, two or more notches 25 may be provided in the middle of the arc section S.

Figure 8:
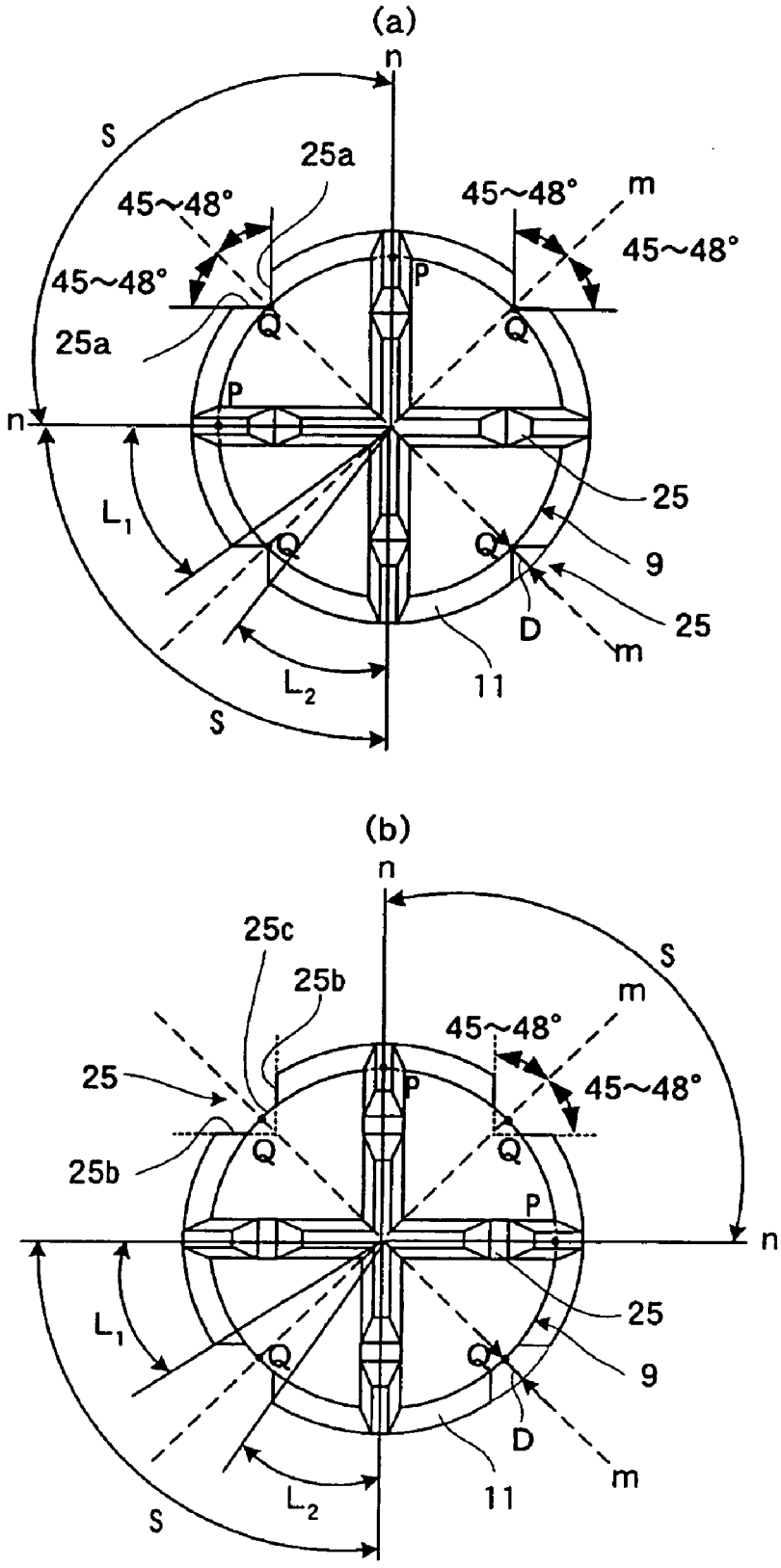
FIG. 8 is a cross-sectional view showing another example of the core of the golf ball of FIG. 1.
Figure 9:
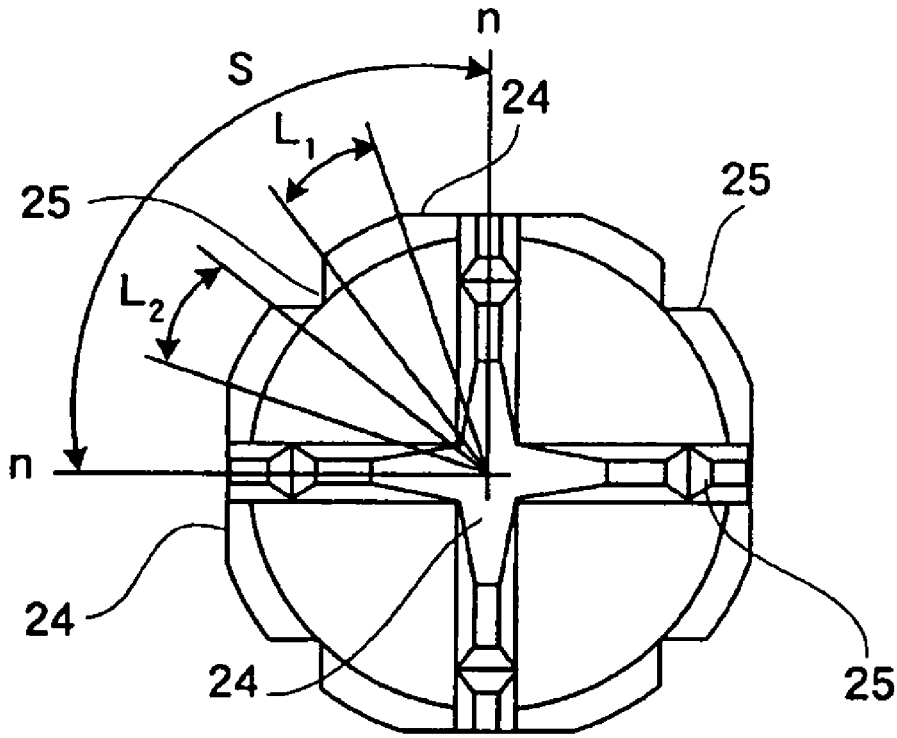
FIG. 9 is a cross-sectional view showing another example of the core of the golf ball of FIG. 1.

As shown in FIG. 9, it is also possible that the arc section S have a notch 24 as shown in FIG. 5, FIG. 6, or FIG. 7 and a notch 25 as shown in FIG. 8. As shown in FIGS. 8 and 9, it is preferable that the length L ($=L_1+L_2$) of the arc section S without a notch be no less than 10 mm.

In the above-described embodiment, the thickness of the interlayer 5 and the height of the rib 11 are the same; however, they do not necessarily have to be the same. For example, it is possible to make the thickness of the interlayer 5 greater than the height of the rib 11. However, it is preferable that the thickness of the interlayer 5 be slightly greater than the height of the rib 11, for example, by 1.5 mm or less.

Figure 10:
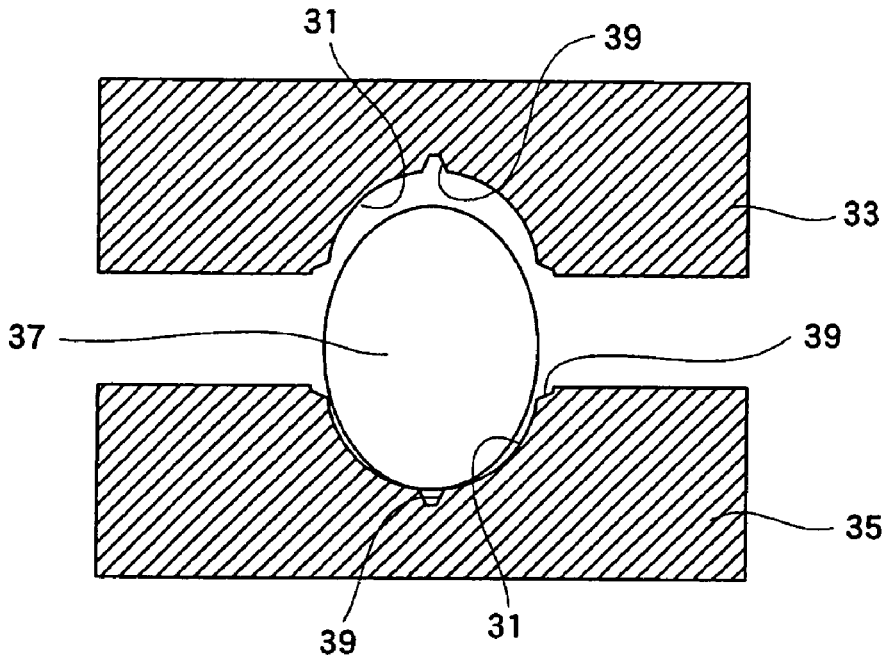
FIG. 10 shows an example of a method for manufacturing the golf ball of FIG. 1.
Figure 10:
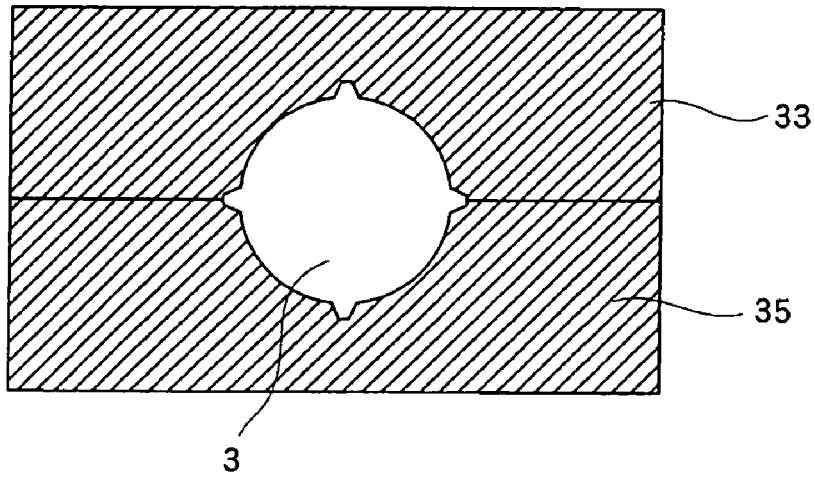
Figure 11:
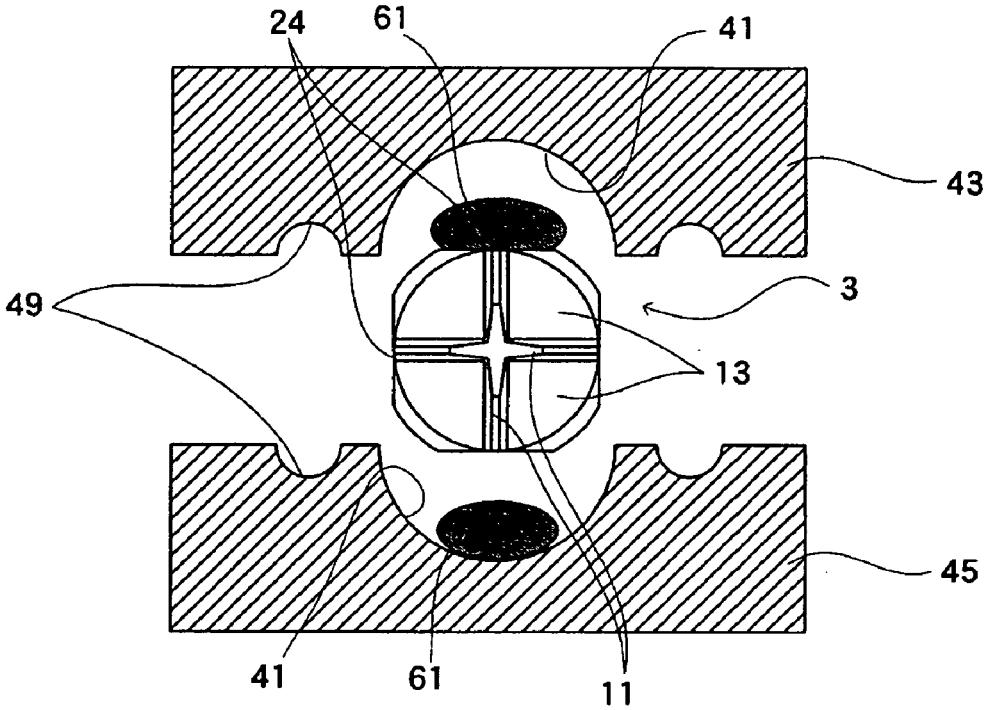
FIG. 11 shows another example of a method for manufacturing the golf ball of FIG. 1.
Figure 11:
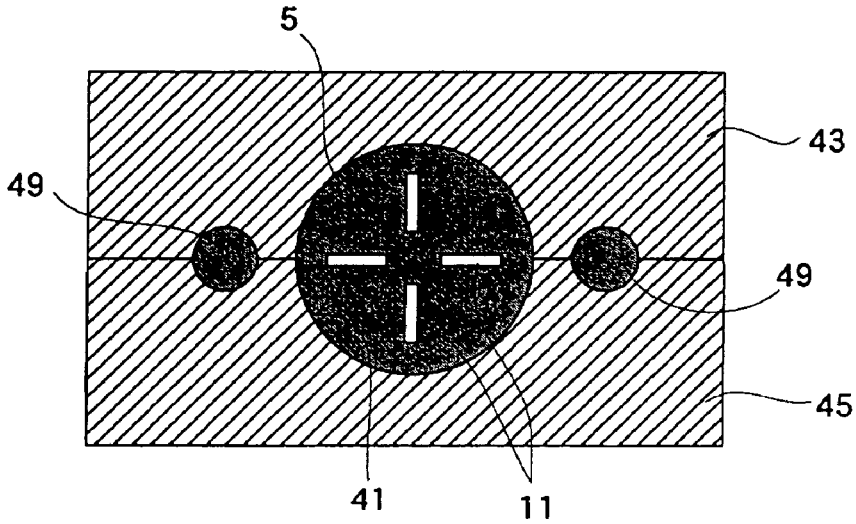

One example of a method for manufacturing a golf ball having the above-described structure is explained next with reference to drawings. This manufacturing method, wherein an interlayer is formed from a rubber composition, is explained below. FIGS. 10 and 11 show the method for manufacturing a three-piece golf ball comprising the core of FIG. 5.

First, as shown in FIG. 10, a predetermined amount of unvulcanized rubber composition 37 is placed between the upper mold 33 and lower mold 35 each having a hemispherical depression 31. As described above, this rubber composition comprises a base rubber, a cross-linking agent, a metal salt of unsaturated carboxylic acid, and a filler, mixed by a Banbury mixer, rolls, or like mixing equipment. Then, this rubber composition is press molded at 130 to 180° C. and a core 3, as shown in FIG. 5, is obtained. The depressions 31 of the upper mold 33 and the lower mold 35 have grooves 39, each having a trapezoidal profile in its sideways cross-section, that form three ribs 11. The surfaces of the depressions 31 are roughly finished by rough grinding. By roughly finishing them, it is possible to make fine irregularities on the surface of the obtained core 3, thus increasing the contact with the interlayer 5.

Then, as shown in FIG. 11, an interlayer 5 is formed by press molding. As shown in FIG. 11A, the mold for the interlayer comprises an upper mold 43 and a lower mold 45, each having a hemispherical depression 41. The depressions 41 of the upper mold 43 and lower mold 45 have the same kind of roughly finished surfaces as those of the molds for the core. Around each depression 41, a plurality of depressions 49 for holding excess flow are formed.

As shown in FIG. 11A, an unvulcanized rubber composition 61 is inserted into the depression 41 of the lower mold 45, a rubber composition 61 is placed on the above-obtained core 3, and the core 3 is positioned between the upper mold 43 and the lower mold 45. Consequently, as shown in FIG. 11B, the upper mold 43 and the lower mold 45 are brought into contact. The rubber composition 61 is subjected to full vulcanization at 140 to 165° C. for 5 to 25 minutes, and press molding, obtaining an interlayer 5.

Figure 12:
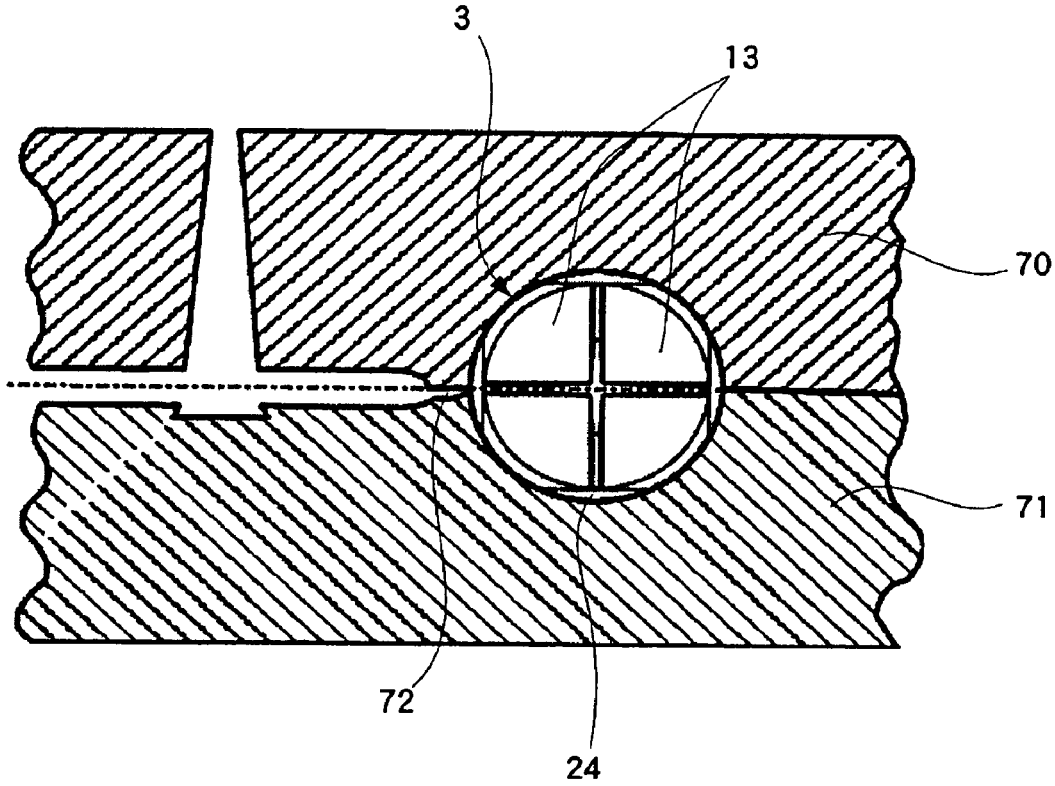
FIG. 12 shows yet another example of a method for manufacturing the golf ball of FIG. 1.

At this time, the rubber compositions 61 placed on the core 3 and in the depression 41 of the lower mold 45 fill the depressions 13 while being pressed against the surface of the core 3. As described above, the two adjacent depressions 13 communicate with each other through notches 24, and therefore the rubber composition spreads throughout each depression and uniformly fills the space therein. The interlayer 5 may also be molded by injection molding using, for example, a mold as shown in FIG. 12. In this case, if no notch is provided, it is impossible to uniformly place the rubber composition in each depression 13 without providing a gate for each depression 13. However, by providing notches 24 to the ribs 11, it is possible to uniformly insert the rubber composition into the depressions 13 by inserting the rubber composition even from a single gate 50 after placing the core 3 in the molds 47 and 48.

When the molding of the interlayer 5 is completed, the core 3 covered with the interlayer 5 is removed from the mold. Thereafter, a cover 7 is applied to the surface of the interlayer 5 by press molding or injection molding in such a manner that the cover has predetermined dimples, thus obtaining a three-piece golf ball.

As described above, notches 24 are provided in the ribs 11 and the two adjacent depressions 13 communicate with each other through the notches 24, and therefore the rubber composition 61 spreads throughout the depressions and uniformly fills the space therein when pressed from any position on the surface of the core 3. It is thus possible to cover the core 3 with the interlayer in a single press molding step. As a result, the manufacturing time can be significantly reduced.

A method for manufacturing a golf ball comprising an interlayer with notches is explained above. However, a golf ball without notches can also be manufactured by almost the same method. However, when notches are not provided, it is necessary to conduct press molding by arranging the interlayer material so as to spread throughout the depressions, or, when injection molding is conducted, a plurality of gates corresponding to the depressions must be provided.

In the golf ball of the present invention, because the interlayer is harder than the core and has an effect on the bounce resilience property, it is possible to vary the characteristics of the ball by changing the thickness of the interlayer. For example, the thicker the interlayer becomes, the more the golf ball will be suited for a club such as a driver, which is designed for obtaining a longer carry distance. In other words, when a driver is used, the striking direction is mainly directed toward the center of the ball, and therefore the thicker the interlayer becomes, the more it is possible to prevent the striking force from being transferred to the low-hardness core. This reduces the deformation amount of the ball and increases its resilience. As a result, it is possible to increase the carry distance. However, because the interlayer is harder than the core, if the height of the ribs is increased, the thickness of the high-hardness interlayer is accordingly increased. This results in a hard feeling when the ball is hit.

Rather than merely increasing the height of the ribs and the thickness of the interlayer as described above, the rib and interlayer structure described below makes it possible to further increase the carry distance. This is described in detail in the second embodiment.

Second Embodiment

Figure 13:
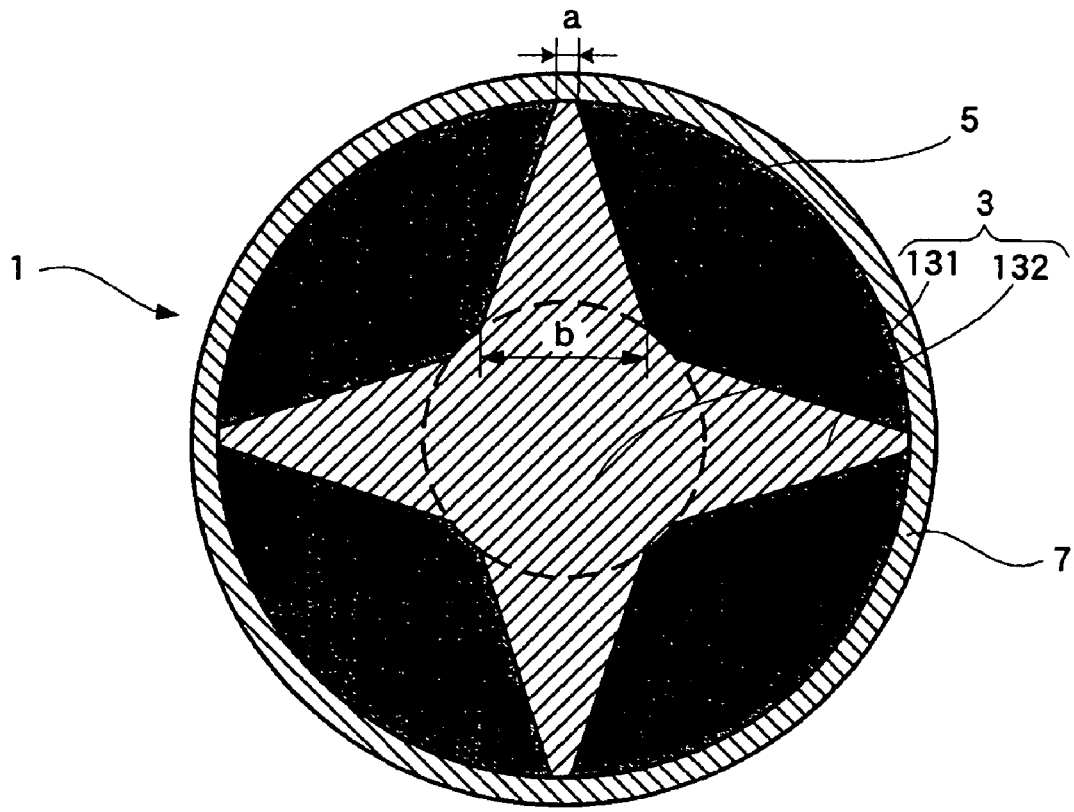
FIG. 13 is a cross-sectional view showing a golf ball of a second embodiment of the present invention.

A second embodiment of the multi-piece golf ball of the present invention is explained next with reference to the drawings. FIG. 13 is a cross-sectional view of the golf ball of the present embodiment. As with the golf ball of the first embodiment, the golf ball of the second embodiment comprises a core 3, an interlayer 5, and a cover 7, wherein depressions surrounded by ribs 132 are formed into a cone-like shape. Note that the diameter of the golf ball is the same as that of the first embodiment.

Figure 14:
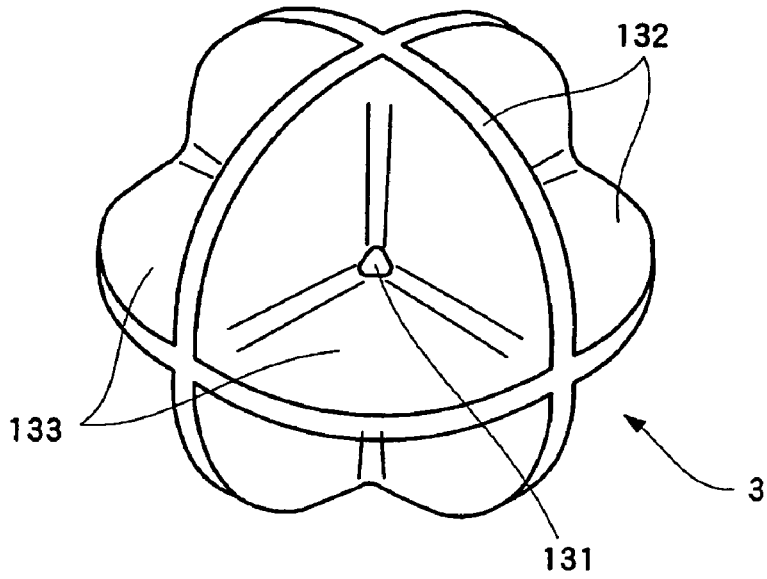
Figure 14:
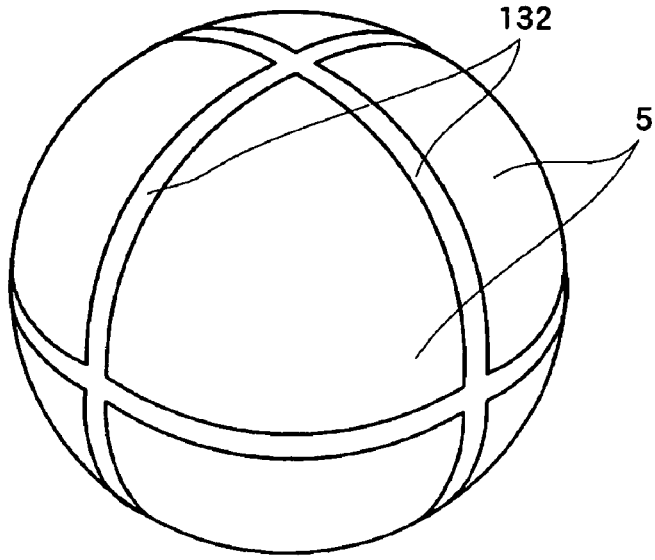

FIG. 14 is a perspective view, wherein FIG. 14A shows a core and FIG. 14B shows a semifinished product covering the core with an interlayer. As shown in FIG. 14A, the core 3 is composed of a rubber composition, and comprises a spherical main part 131 and three ribs 132 formed on the spherical main part 131. It is preferable that the diameter of the main part 131 be 15.4 to 31.3 mm.

Each of the ribs 132 extends along one of three great circles drawn around the main part 131 so as to intersect each other at right angles. Eight depressions 133 are formed in the surface of the main part 131 by the ribs 132. The height of the ribs 51 is preferably 5.0 to 11.0 mm, and more preferably 7.0 to 9.0 mm. The height of the ribs 132 may be outside the above range; however, collapsing of the ribs can be prevented during the manufacturing process by setting the height of the ribs not to exceed 11.0 mm.

As shown in FIG. 13, each rib 132 is structured so as to have a trapezoidal profile in its sideways cross-section in such a manner that its width increases as it approaches the main part 131. It is preferable that the width of the top portion a of each rib 132 in the outward radial direction be 1.5 to 3.0 mm and the width of the bottom portion b in the inward radial direction be 7.0 to 12.0 mm. The widths of the bottom portion of each rib 132 may be set outside this range; however, by setting a lower limit for the width of each bottom portion of the rib 132, it is possible to prevent the rib 132 from being deformed by the filling pressure that results from tightly closing the mold when inserting the material for the interlayer 5 during the manufacturing process. As a result, it is possible to accurately hold the main part 131 in the center of the mold. Furthermore, by setting an upper limit for the width of the bottom portion of each rib 132 as described above, it is possible to prevent the area where the low-hardness rib 132 and the inner surface of the cover 7 are attached to each other from becoming unduly large, thus ensuring an adequate bounce resilience when hitting the ball. Such a shape for the ribs 132 allows the depressions 133 to form a triangular pyramid-like shape surrounded by the three ribs 132 with the surface of the main part 131 being slightly exposed.

The interlayer 5 has a thickness that is almost the same as the height of the ribs 132 and is inserted into the eight depressions 133 surrounded by the ribs 132, with its outline forming a substantially spherical shape. As shown in FIG. 14B, the tops of the ribs 132 are exposed from the interlayer 5. Note that the hardnesses of the core 3 and the interlayer 5 are the same as those of the first embodiment.

The cover 7 covers the top portions of the ribs 132 and the interlayer 5, with predetermined dimples (not shown) being formed on the outer surface of the cover 7. The thickness of the cover 7 is preferably 0.8 to 2.6 mm, and more preferably 1.6 to 2.0 mm. As with the first embodiment, the Shore D hardness of the cover 7 is preferably 56 to 68.

The materials of the core 3, interlayer 5, and cover 7 may be the same as those used in the first embodiment.

In the thus-formed golf ball 1, even if the ribs 132 are comparatively tall, because the width of the base portion of the ribs 132 is greater than the top portion thereof, it is possible to prevent the ribs 132 from collapsing when pressure is applied during molding. Because the ribs of the golf ball are relatively soft, having the above-explained structure is particularly advantageous. Furthermore, because the thickness of the high-hardness interlayer 5 becomes greater in relation to this rib 132 height, it is possible to obtain a high bounce resilience property. Therefore, even at a slow head speed, a long carry distance can be achieved.

As shown in FIG. 13, in the golf ball of the present embodiment, the proportion of the interlayer 5 gradually decreases as it approaches the center of the ball, and accordingly the proportion of the low-hardness ribs 132 increases. Therefore, the influence of impact is more weakly transmitted as it approaches the center of the ball; however, because the proportion of the ribs increases, the deformation of the ribs can be ensured. As a result, even if the ribs become taller, it is possible to apply a force that surely opposes the backspin of the golf ball, and the carry distance can be increased further.

Also, because the ribs 132 become longer, the diameter of the main part 131 of the core 3 becomes smaller, and therefore it is possible to satisfactorily vulcanize the core 3 including around the center thereof, obtaining a core 3 without variations in hardness. This reduces the manufacturing time as well.

Figure 15:
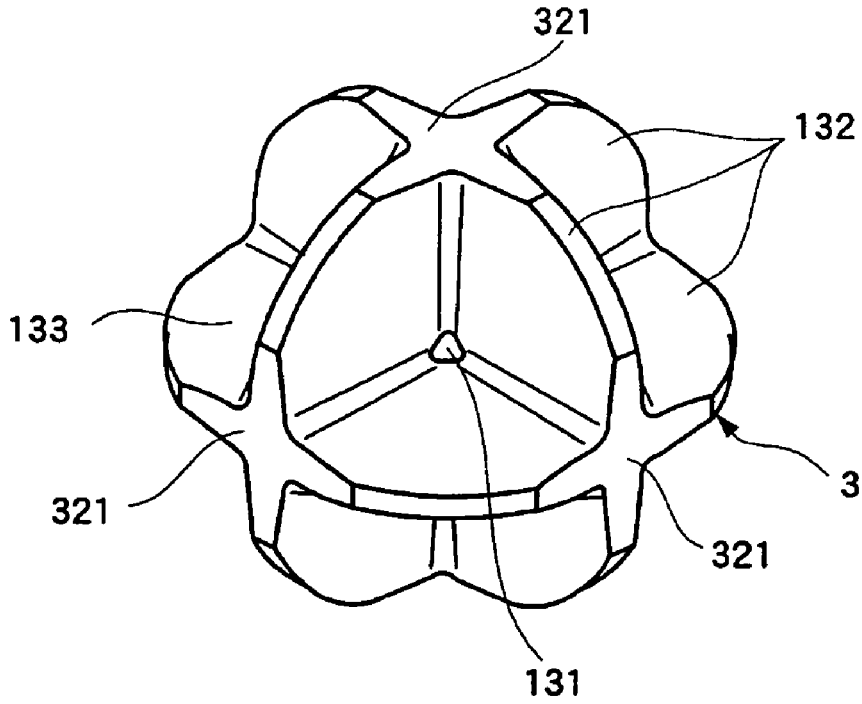
FIG. 15 is a perspective view showing another example of the core of the golf ball of FIG. 13.
Figure 16:
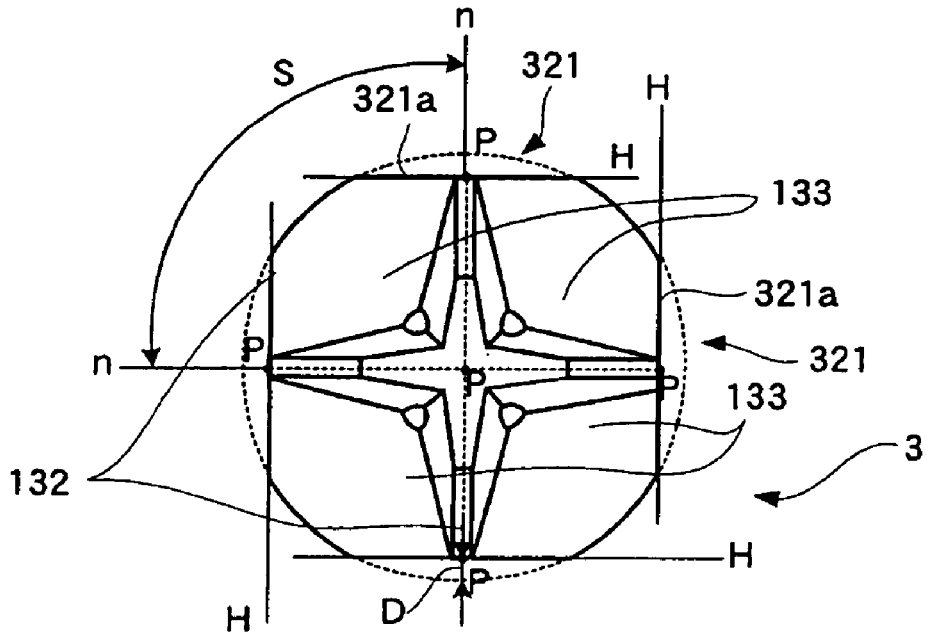
FIG. 16 is a cross-sectional view showing another example of the core of the golf ball of FIG. 13.

It is also possible to form notches in the ribs of the golf ball of the present embodiment in the same manner as in the first embodiment. As shown in FIG. 15, it is possible to form notches in portions of the ribs 132. In this example, each rib 132 has a notch 321 on the intersection of the great circles. To be more specific, as shown in FIG. 16, the notch 321 is structured so as to have a bottom surface 321*a* extending along a plane H perpendicular to the normal line n of the main part 131 that passes through the intersection P of the great circles. In other words, the notch 321 is formed by excising the rib 132 at the plane H. Note that it is preferable that the depth D of the notch 321, i.e., the length from the top portion of the virtual rib 132 without a notch 321 to the innermost portion of the notch 321, be 1.2 to 2.4 mm.

Figure 17:
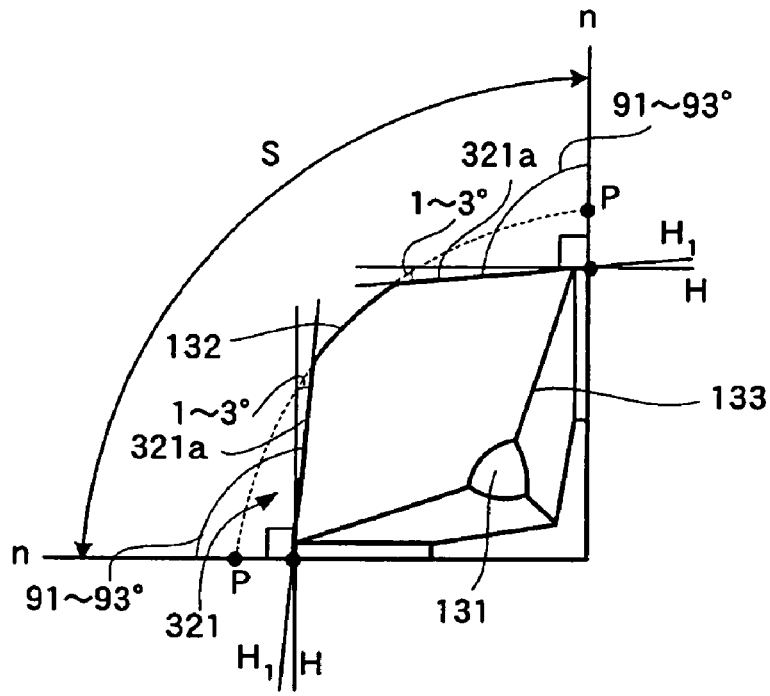
FIG. 17 is a cross-sectional view showing another example of the core of the golf ball of FIG. 13.

By forming notches 321 in this manner, four depressions 133 that are disposed so as to have their common center at an intersection P of the great circles are made to communicate with each other, and the material for the interlayer can readily spread between the depressions 133 via the notches 321. In this case, as shown in FIG. 17, it is also possible to form the bottom surface 321*a* of each notch 321 along a plane $H_1$ that extends away from the plane H by being slanted toward the center of each rib 11 by 1 to 3°, i.e., a plane having an angle made between the normal line n of the main part 131 passing through the intersection P is 91 to 93° as viewed from the front. This arrangement enables the angle to serve as a draft, and, for example, when a core is molded using two molds, such as an upper mold and a lower mold, the core 3 can easily be removed from the mold.

Figure 18:
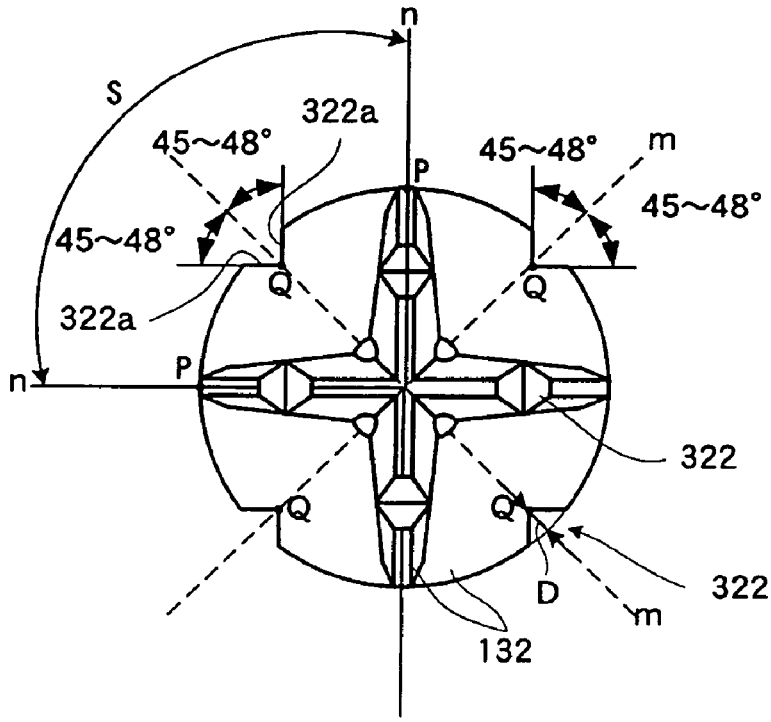
FIG. 18 is a cross-sectional view showing another example of the core of the golf ball of FIG. 13.

It is also possible to form a notch in the middle of the arc section S formed between each intersection P of each rib 132. In other words, as shown in FIG. 18, it is possible to form a notch 322 so as to have two bottom surfaces 322*a* each extending toward the intersections P from a point Q on a normal line m of the main body 131 that passes through the mid point of each arc section in the arc direction. In this case, it is preferable that the angle between the bottom surface 322*a* and the normal line m be 45 to 48° as viewed from the front. This arrangement makes it possible to easily remove the core 3 from the mold.

Note that the golf ball of the present embodiment has almost the same arrangement as that of the first embodiment except for the height and shape of the rib, and therefore the same method explained in the first embodiment (FIGS. 10 to 12) can be employed.

Third Embodiment

Figure 19:
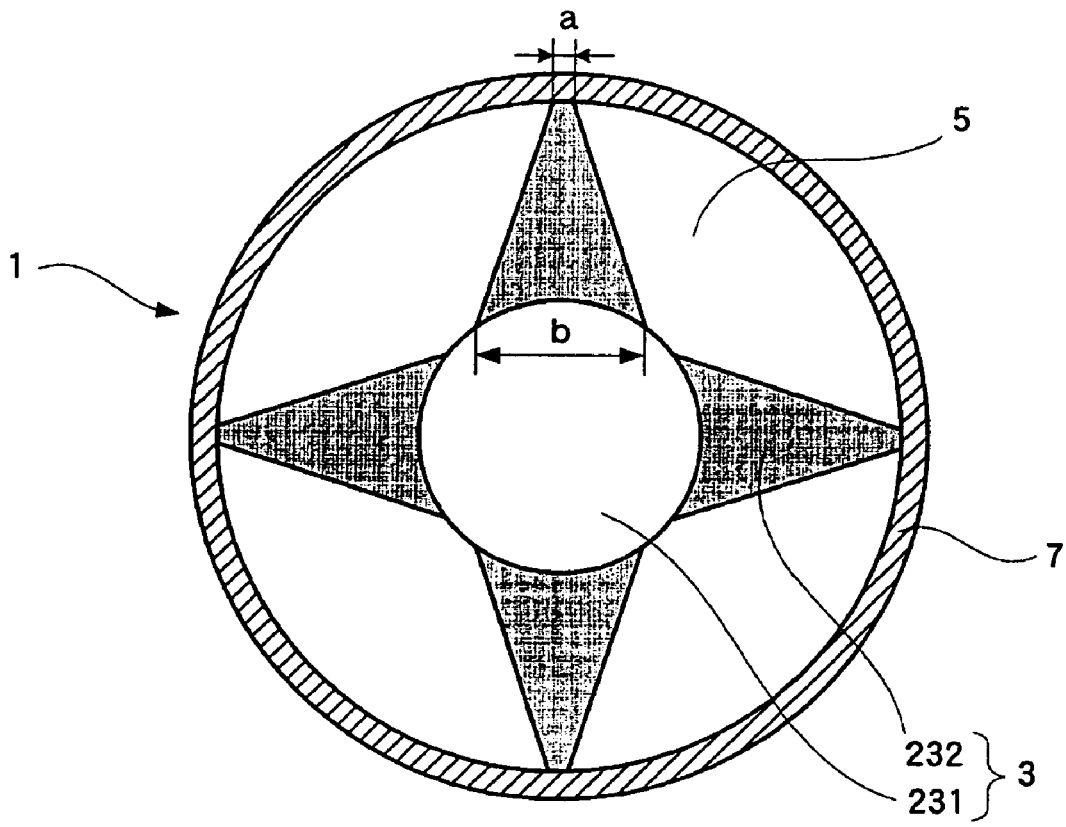
FIG. 19 is a cross-sectional view showing a golf ball of a third embodiment of the present invention.

A third embodiment of the multi-piece golf ball of the present invention is explained below with reference to drawings. FIG. 19 is a cross-sectional view of the golf ball of the present embodiment. As with the golf balls of the first and second embodiments, the golf ball of the third embodiment comprises a core 3, an interlayer 5, and a cover 7. However, whereas the golf balls of the first and second embodiments illustrate examples of golf balls wherein the main part and ribs, which compose the core 3, have the same hardness, the golf ball of the present embodiment has a different hardness in the main part and the ribs. Note that the diameter of the golf ball of the present embodiment is the same as that of the first embodiment.

Figure 20:
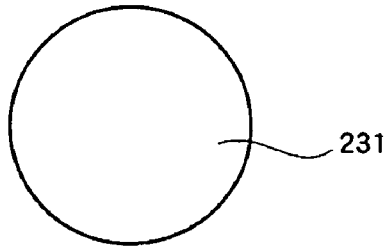
FIG. 20 is a perspective view showing the main part, ribs, and interlayer of the golf ball of FIG. 19.
Figure 20:
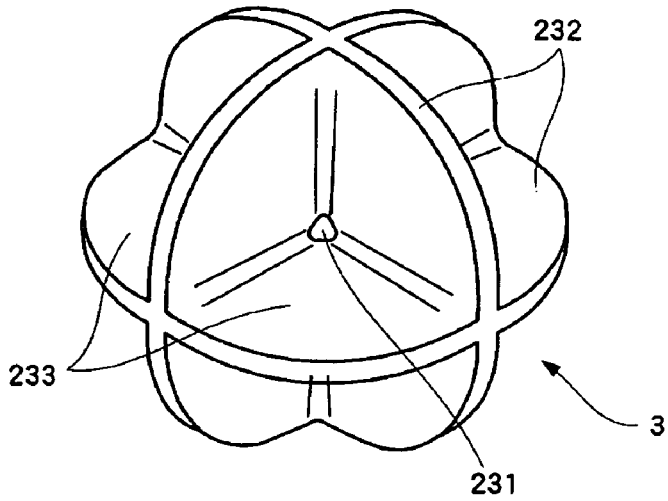
Figure 20:
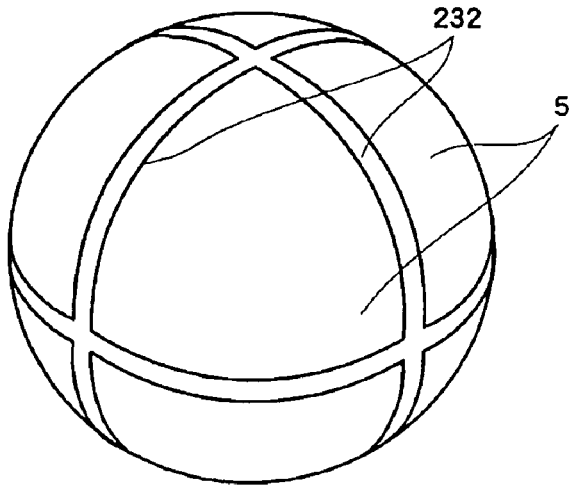

FIG. 20 is a perspective view, wherein FIG. 20A shows a main part 231, FIG. 20B shows a core 3 comprising the main part 231 and ribs 232 provided on the main part 231, and FIG. 20C shows a semifinished product comprising the core 3 covered with an interlayer 5. As shown in FIG. 20A, the main part 231 is formed into a spherical shape and composed of a rubber composition. The diameter of the main part 231 is preferably 15.1 to 28.3 mm, and more preferably 17.9 to 25.9 mm.

The main part 231 can be manufactured using a known rubber composition comprising a base rubber, a cross-linking agent, an unsaturated carboxylic acid metal salt, filler, etc. Specific examples of the base rubber include natural rubber, polyisobutylene rubber, styrenebutadiene rubber, EPDM, etc. Among these, it is preferable to use high-cis polybutadiene that contains 40% or more, and preferably 80% or more cis-1,4-bonds.

Specific examples of cross-linking agents include dicumyl peroxide, t-butylperoxide, and like organic peroxides; however, it is particularly preferable to use dicumyl peroxide. The compounding ratio of the cross-linking agent is generally 0.3 to 5 parts by weight, and preferably 0.5 to 2 parts by weight per 100 parts by weight of the base rubber.

As for metal salts of unsaturated carboxylic acids, it is preferable to use monovalent or bivalent metal salts of acrylic acid, methacrylic acid, and like $C_3$ to $C_8$ unsaturated carboxylic acids. Among these, the use of zinc acrylate can improve the ball's bounce resilience and is particularly preferable. The compounding ratio of the unsaturated carboxylic acid metal salt is preferably 10 to 40 parts by weight per 100 parts by weight of base rubber.

Examples of filler include those generally added to cores. Specific examples thereof include zinc oxide, barium sulfate, calcium carbonate, etc. The preferable compounding ratio of the filler is 2 to 50 parts by weight per 100 parts by weight of base rubber. If necessary, it is also possible to add an antioxidant, a peptizer, and the like.

Note that not only the above-mentioned rubber compositions but also known elastomers can be used as the material for the main part 231.

As shown in FIG. 20B, three ribs 232 are provided on the surface of the main part 231 so as to intersect each other at right angles. To be more specific, each rib 232 extends along one of the great circles intersecting each other at right angles on the surface of the main part 231. These ribs 232 form eight depressions 233 on the surface of the main part 231. The ribs 232 have the same shape and height as those of the ribs 132 in the second embodiment, and are disposed so that the main part 231 is exposed at the bottom of the depression 233. Because of this, the depressions 233 form a triangular pyramid-like shape surrounded by the three ribs 232 and the slightly exposed surface of the main part 231.

The ribs 232 are composed of a rubber composition, and the same materials for the main part 231 described above can be used. However, in the present embodiment, by changing the compounding ratio of the unsaturated carboxylic acid or organic peroxide of the ribs 232 from that of the main part 231, the hardness of the main part 231 is differentiated from that of the ribs 232. For example, by increasing the amounts of the unsaturated carboxylic acid and organic peroxide in the rib 232, it is possible to make the hardness of the ribs 232 greater than that of the main part 231.

As shown in FIG. 20C, the thickness of the interlayer 5 is substantially the same as the height of the rib 232. The interlayer 5 is inserted into the eight depressions 233, and its outline forms a substantially spherical shape. Here, the interlayer 5 is formed into triangular cone-like shapes by being inserted into each depression 233. The top portions of the ribs 232 are exposed through the interlayer 5. The hardness of the interlayer 5 is set to be greater than that of the ribs 232.

The interlayer 5 may be composed of a rubber composition or an elastomer having almost the same components as that of the ribs 232. When the interlayer 5 is composed of a rubber composition, it is preferable that the compounding ratio of the unsaturated carboxylic acid and organic peroxide be increased to make its hardness greater than that of the ribs 232. When the interlayer 5 is composed of an elastomer, the elestomer can be one of those used for the interlayer 5 in the first embodiment.

As shown in FIG. 19, the cover 7 is provided over the top portions of the ribs 232 and the interlayer 5, with predetermined dimples (not shown) being formed on the outer surface of the cover 7. The cover 7 may be the same as the cover 7 in the first embodiment.

In the golf ball of the present embodiment, it is also possible to form notches in the ribs 232 in the same manner as in the second embodiment (see FIG. 15).

In the golf ball of the present embodiment, because the hardness of the interlayer 5 is greater than that of the ribs 232, as with the first and second embodiments, it is possible to increase the carry distance while maintaining a soft feeling when the ball is hit with an iron.

Furthermore, by varying the hardness of the main part 231 in responses to needs, desired properties can be obtained. In other words, by making the hardness of the main part 231 lower than that of the ribs 232, when a driver is used, excess spin can be easily suppressed, and therefore it is possible to increase the launch angle and obtain a longer carry distance. At the same time, by making the hardness of the main part 231 greater than that of the interlayer 5, the bounce resilience of the ball is enhanced and the carry distance is increased.

By setting the hardness of the main part 231 in the above-described range, i.e., greater than the hardness of the rib 232 and the less than that of the interlayer 5, it is possible to suitably select the spin amount and resilience property depending on the head speed, etc., to increase the carry distance.

The golf ball of the present embodiment can be manufactured, for example, by the method described below.

Figure 21:
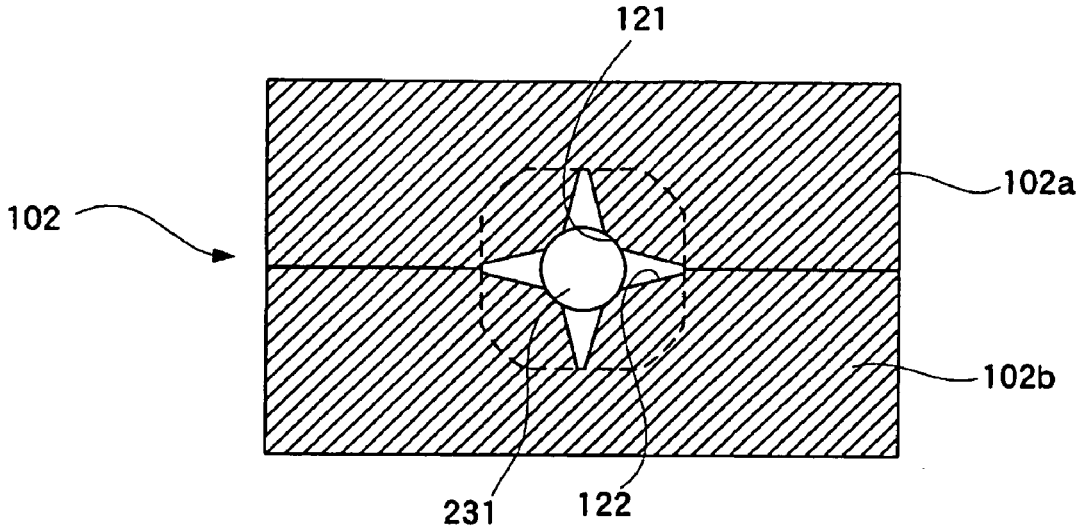
FIG. 21 is a diagram indicating a method for manufacturing the golf ball of the third embodiment of the present invention.
Figure 21:
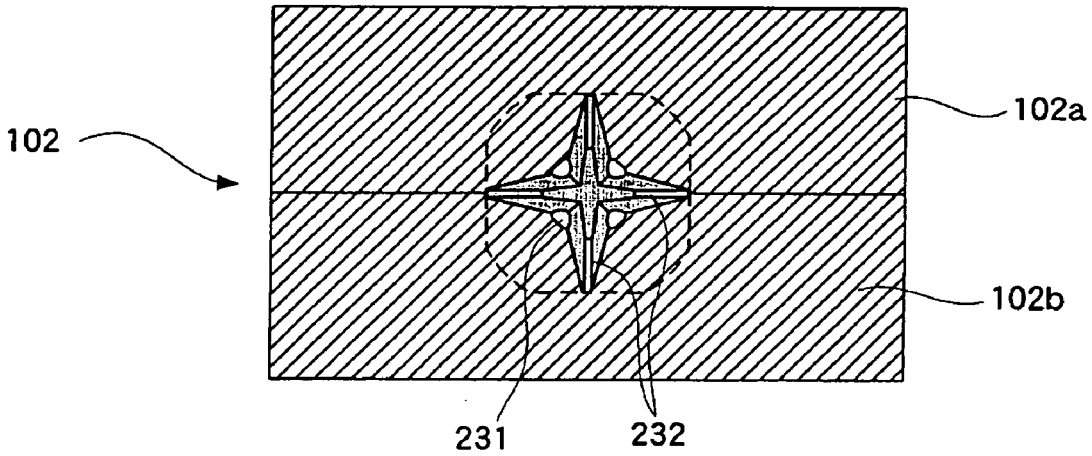

First, a main part 231 is formed by press molding a rubber composition in a mold, for example, at 130 to 160° C. for 5 to 25 minutes. Here, the main part 231 may be composed of an elastomer as described above. In this case, the main part 231 can be formed by press molding or injection molding. Next, the thus-formed main part 231 is placed in a first mold 102 as shown in FIG. 21A. The first mold 102 comprises an upper mold 102*a* and a lower mold 102*b*, and the upper mold 102*a* and the lower mold 102*b* each comprises a hemispherical receiving part 121 that corresponds to the surface of the main part 231. In the surface of the receiving part 121, cavities 122 for forming the ribs 232 are provided. The cavities 122 are composed of a plurality of grooves having substantially the same depth formed along the great circles of the receiving part 121, wherein the grooves in the intersections of the three great circles are shallower than those in the other portions. This forms the above-described notches in the ribs 232. The surfaces of the cavities 122 are roughly finished by rough grinding. By roughly finishing, it is possible to make fine irregularities in the surface of the obtained ribs 232, thus increasing the contact with the interlayer 5.

As shown in FIG. 21B, a plurality of ribs 232 are formed on the surface of the main part 231 by placing the main part 231 in the receiving part 121 of the first mold 2, and placing an unvulcanized rubber composition N1, which is a material for the ribs, in the cavity 122, and conducting full vulcanization, for example, at 140 to 165° C. for 5 to 25 minutes and press molding.

Figure 22:
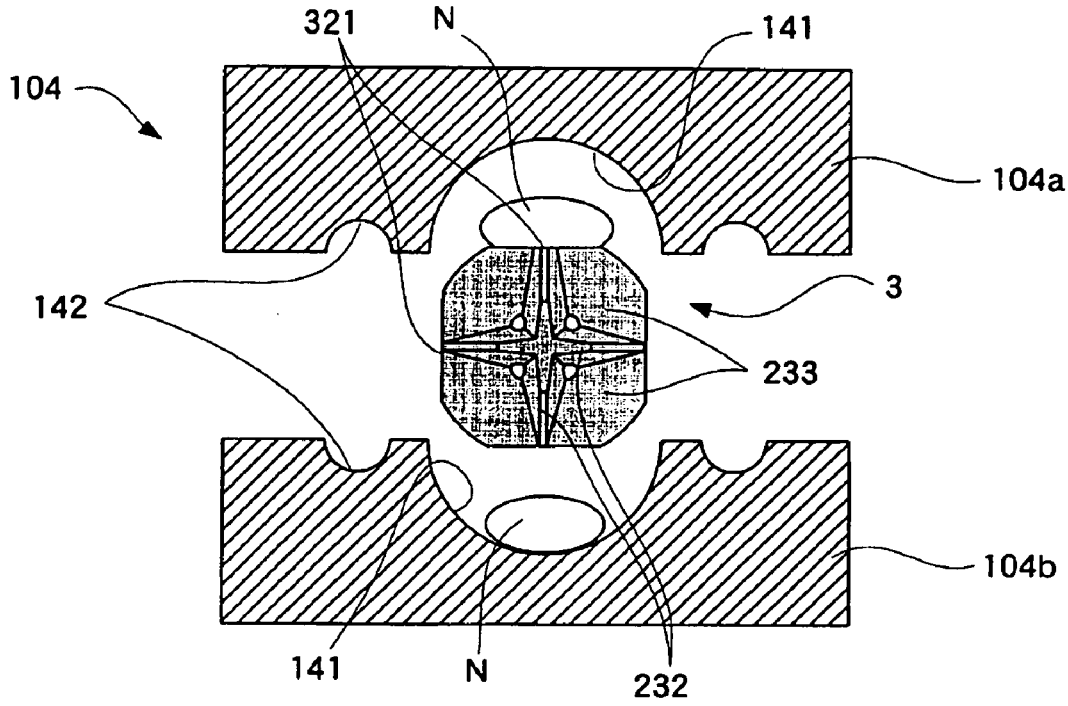
FIG. 22 is a diagram indicating another method for manufacturing the golf ball of the third embodiment of the present invention.
Figure 22:
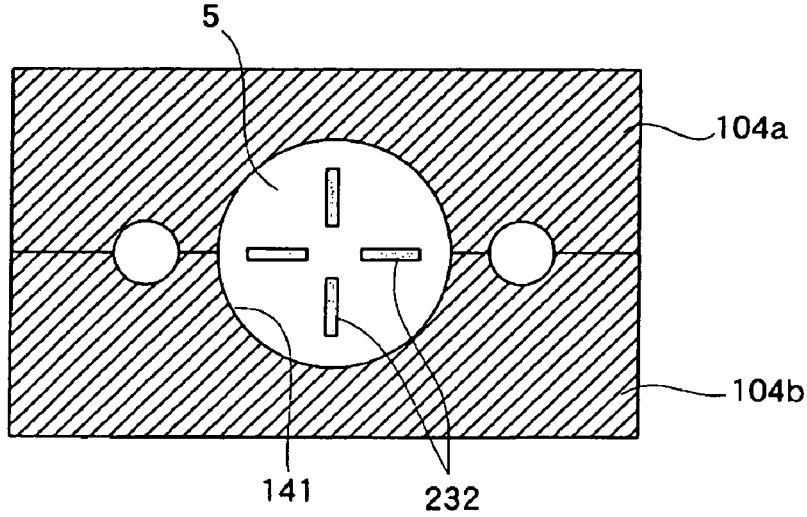

Subsequently, the core 3 comprising the main part 231 and the ribs 232 is removed from the first mold 102, and placed in the second mold 104. As shown in FIG. 22A, the second mold 104 comprises an upper mold 104*a* and a lower mold 104*b*, the upper mold 104*a* and the lower mold 104*b* each has a spherical cavity 141 corresponding to the outermost diameter of the ribs 232. In other words, the top portions of the ribs 232 are designed to contact the surface of the cavity 141. The cavities 141 of the upper mold 104*a* and lower mold 104*b* have the same kind of roughly finished surfaces as those of the first mold 102. Around each cavity 141, a plurality of depressions 142 for holding excess flow are formed.

As shown in FIG. 22A, an unvulcanized rubber composition N is placed in the cavity 141 in the lower mold 104*b*, a rubber composition N is placed on the core 3 that was formed as descried above, and the core 3 is placed between the upper mold 104*a* and the lower mold 104*b*. Then, as shown in FIG. 22B, the upper mold 104*a* and the lower mold 104*b* are brought into contact, and the rubber composition N is fully vulcanized at 140 to 165° C. for 5 to 25 minutes and subjected to press molding, thus obtaining an interlayer 5.

Here, the rubber composition N placed on the core 3 and in the cavity 141 of the lower mold 104*a* fill the depressions 233 while being pressed against the surface of the semifinished product. As described above, the adjacent depressions 233 communicate with each other through notches 321, and therefore the rubber composition spreads throughout the depressions 233 and uniformly fills the space therein. As described above, the interlayer 5 may be formed by injection molding (see FIG. 12). In this case, if no notches are provided in the ribs 232, it is impossible to uniformly place the rubber composition N in each depression 233 without providing a gate for each depression 233. However, by providing notches in the ribs 232, it is possible to uniformly place the rubber composition in the depressions 233 even by inserting the rubber composition from a single gate.

As described above, a notch is provided in each rib 232 and the adjacent depressions 233 communicate with each other through the notch, and therefore the rubber composition N spreads throughout the depressions 233 and uniformly fills the space therein when pressed from any position on the surface of the core 3. Therefore, it is possible to easily cover the core 3 with the interlayer 5, significantly reducing the manufacturing time. Here, the interlayer 5 is composed of a rubber composition, but it is also possible to form the interlayer 5 with an elastomer. When an elastomer is used, the interlayer 5 may be formed by injection molding.

When the molding of the interlayer 5 is completed, a semifinished product comprising a main part 231, ribs 232 and an interlayer 5 is removed from the second mold 104. Subsequently, by covering the semifinished product with the cover 7 by press molding or injection molding in such a manner that the cover 7 has predetermined dimples thereon, a golf ball of the present embodiment is obtained.

Note that, a golf ball comprising an interlayer 5 with notches is explained above; however, it is also possible to form a golf ball comprising an interlayer 5 without notches in almost the same manner. When notches are not provided, it is necessary to conduct press molding by positioning the interlayer material so that the material can be inserted into each of the depressions, or, when injection molding is conducted, a plurality of gates corresponding to each depression must be provided.

One example of a method for manufacturing the golf ball of the present embodiment is explained above. In the manufacturing method of the present invention, by suitably selecting the materials for the main part 231, ribs 232, and interlayer 5, it is possible to control the hardness of each component, and this makes it possible to easily manufacture a golf ball having the desired properties as described above.

EXAMPLES

Examples of the present invention and Comparative Examples will be explained below. First, nine types of golf balls according to the present invention are compared with three types of golf balls according to Comparative Examples. The Examples correspond to the first and second embodiments of the present invention.

TABLE 1

| | | Ex. 1 | Ex. 2 | Ex. 3 | Ex. 4 | Ex. 5 | Ex. 6 | Ex. 7 | Ex. 8 | Ex. 9 | Comp. Ex. 1 | Comp. Ex. 2 | Comp. Ex. 3 |
|---|---|---|---|---|---|---|---|---|---|---|---|---|---|
| Core | BR | 100 | 100 | 100 | 100 | 100 | 100 | 100 | 100 | 100 | 100 | 100 | 100 |
| | Zinc oxide | 5 | 5 | 5 | 5 | 5 | 5 | 5 | 5 | 5 | 5 | 5 | 5 |
| | Barium sulfate | 17 | 17 | 17 | 17 | 17 | 17 | 17 | 16 | 11 | 17 | 17 | 17 |
| | Crosslinking initiator | 1.5 | 1.5 | 1.5 | 1.5 | 1.5 | 1.5 | 1.5 | 1.5 | 1.5 | 1.5 | 1.5 | 1.5 |
| | Zinc acrylate | 21 | 21 | 21 | 21 | 21 | 21 | 21 | 23 | 36 | 21 | 21 | 21 |
| | Antioxidant | 0.1 | 0.1 | 0.1 | 0.1 | 0.1 | 0.1 | 0.1 | 0.1 | 0.1 | 0.1 | 0.1 | 0.1 |
| Interlayer | BR | 100 | 100 | 100 | 100 | 100 | 100 | 100 | 100 | 100 | 100 | 100 | 100 |
| | Zinc oxide | 5 | 5 | 5 | 5 | 5 | 5 | 5 | 5 | 5 | 5 | 5 | 5 |
| | Barium sulfate | 14 | 15 | 16 | 16 | 14 | 16 | 13 | 16 | 14 | 14 | 15 | 16 |
| | Crosslinking initiator | 1.5 | 1.5 | 1.5 | 1.5 | 1.5 | 1.5 | 1.5 | 1.5 | 1.5 | 1.5 | 1.5 | 1.5 |
| | Zinc acrylate | 28 | 26 | 24 | 24 | 28 | 24 | 31 | 24 | 29 | 28 | 26 | 24 |
| | Antioxidant | 0.1 | 0.1 | 0.1 | 0.1 | 0.1 | 0.1 | 0.1 | 0.1 | 0.1 | 0.1 | 0.1 | 0.1 |
| Cover | HIMILAN 1706 | 50 | 50 | 50 | 50 | 50 | 50 | 50 | 50 | 50 | 50 | 50 | 50 |
| | HIMILAN 1605 | 50 | 50 | 50 | 50 | 50 | 50 | 50 | 50 | 50 | 50 | 50 | 50 |

TABLE 2

| | Thickness of the interlayer (mm) | Ribs | Hardness of the core | Hardness of the interlayer | Hardness of the cover |
|---|---|---|---|---|---|
| Example 1 | 2 | Provided | 48 | 55 | 62 |
| Example 2 | 5 | Provided | 48 | 53 | 62 |
| Example 3 | 8 | Provided | 48 | 51 | 62 |
| Example 4 | 11 | Provided | 48 | 51 | 62 |
| Example 5 | 1.4 | Provided | 48 | 55 | 62 |
| Example 6 | 12.5 | Provided | 48 | 51 | 62 |
| Example 7 | 5 | Provided | 48 | 59 | 62 |
| Example 8 | 5 | Provided | 50 | 51 | 62 |
| Example 9 | 5 | Provided | 56 | 64 | 62 |
| Comp. Ex. 1 | 2 | Not provided | 48 | 55 | 62 |
| Comp. Ex. 2 | 5 | Not provided | 48 | 53 | 62 |
| Comp. Ex. 3 | 11 | Not provided | 48 | 51 | 62 |

Table 1 shows the compounding ratio (parts by weight) of the materials for the golf balls of Examples 1-9 and Comparative Examples 1-3. Table 2 shows the thickness of the interlayer (height of the ribs), whether ribs are provided or not, and the hardness (Shore D hardness) of each component of the golf balls.

The golf balls of Examples 1 and 5 comprise a core having the same structure as that of the core 3 in the first embodiment as shown in FIG. 5, wherein the interlayer of the golf ball of Example 5 is thinner than that of Example 1.

The golf balls of Examples 3, 4 and 6 comprise a core having the same structure as that of the core 3 in the second embodiment as shown in FIG. 15, wherein the interlayer becomes increasingly thicker in the order of Examples 3, 4 and 6.

Figure 23:
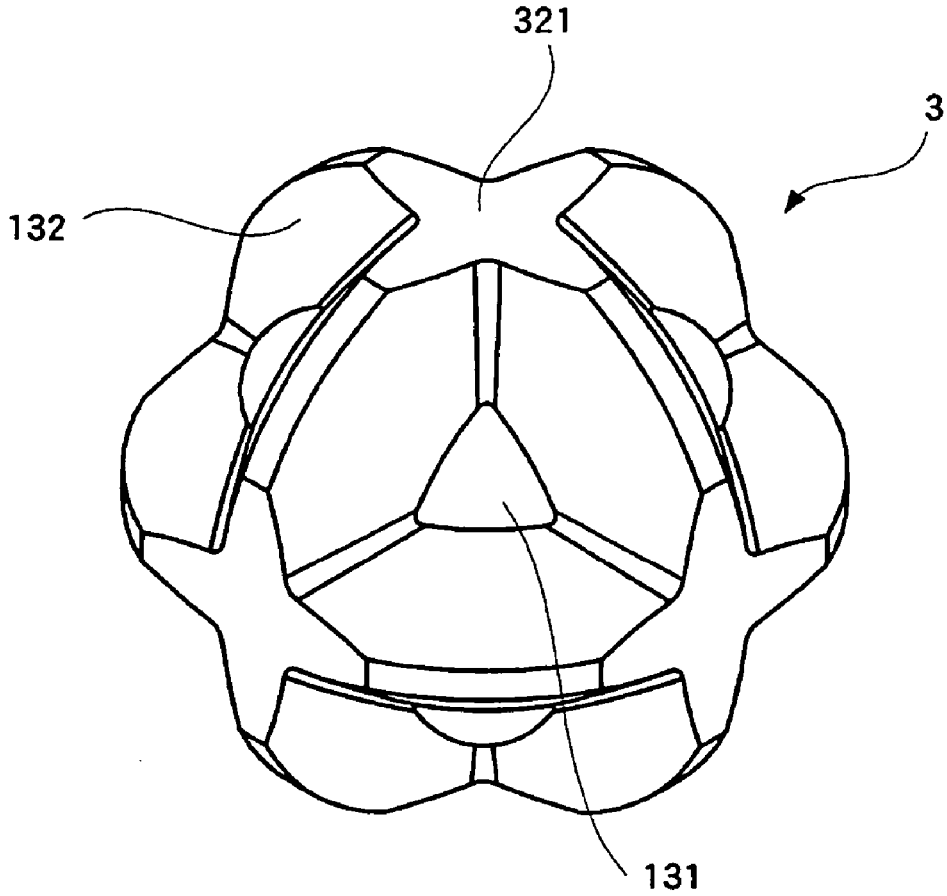
FIG. 23 shows another core structure of a golf ball of the third embodiment of the present invention.

The golf balls of Examples 2, 7, 8 and 9 correspond to the second embodiment, wherein the core has the same structure as that of the core 3 as shown in FIG. 23. In the core 3, the height of the ribs is less than that of the core 3 shown in FIG. 15, and more of the main part 131 is exposed.

Comparative Examples 1-3 are conventional three-piece golf balls wherein no ribs are provided on the core, and the core, the interlayer and the cover are formed concentrically. Comparative Examples 1 to 3 respectively correspond to Examples 1, 2 and 4 with respect to the thickness of the interlayer and the hardness of each component.

Using the golf balls obtained in the Examples and Comparative Examples, which have the above-described structures, hitting tests were conducted using a hitting robot (manufactured by Miyamae Co., Ltd.: product name "SHOT ROBO V") with a number one wood (1W: Mizuno Corporation; Mizuno 300S-II 380, loft angle: 9°, length: 44.75 inches (113.66 cm), shaft flex: S) and a number five middle iron (5I: manufactured by Mizuno Corporation; T-ZOID•MX-15, loft angle: 27°, length: 37.5 inches (95.25 cm), shaft flex: S), and the carry distances were measured. The head speed of the 1W was set at 45 m/s and that of the 5I was set at 35 m/s. Tests of the feeling when the balls were hit (impact feeling) were conducted by ten amateurs using a 1W and a 5I. The ten amateurs were asked to select either 1: soft, 2: slightly soft, 3: fair, 4: slightly hard, or 5: hard to evaluate the feeling when the balls were hit and the average value of all values selected was defined as the feeling value for each Example and Comparative Example. Tables 24 and 25 show graphs of the results.

TABLE 3

| | 1W | | | 5I | | |
|---|---|---|---|---|---|---|
| | Carry (m) | Backspin (rpm) | Feeling | Carry (m) | Backspin (rpm) | Feeling |
| Ex. 1 | 202.5 | 2911 | 2.6 | 134.1 | 3911 | 2.0 |
| Ex. 2 | 203.0 | 2886 | 2.7 | 134.1 | 4012 | 2.6 |
| Ex. 3 | 203.6 | 2855 | 3.3 | 133.6 | 4021 | 3.0 |
| Ex. 4 | 203.8 | 2850 | 3.5 | 133.5 | 4050 | 3.3 |
| Ex. 5 | 200.2 | 2960 | 2.5 | 133.8 | 3857 | 2.2 |
| Ex. 6 | 203.9 | 2849 | 4.0 | 133.5 | 4051 | 3.7 |
| Ex. 7 | 203.5 | 2922 | 4.1 | 133.4 | 3794 | 4.4 |
| Ex. 8 | 200.9 | 2995 | 3.7 | 134.2 | 4008 | 3.8 |
| Ex. 9 | 205.0 | 2794 | 4.2 | 135.2 | 3811 | 4.5 |
| Comp. Ex. 1 | 200.0 | 2981 | 2.6 | 134.2 | 3866 | 4.0 |
| Comp. Ex. 2 | 200.4 | 2986 | 2.9 | 134.1 | 3988 | 4.2 |
| Comp. Ex. 3 | 201.1 | 2995 | 3.8 | 133.7 | 4026 | 4.3 |

Figure 24A:
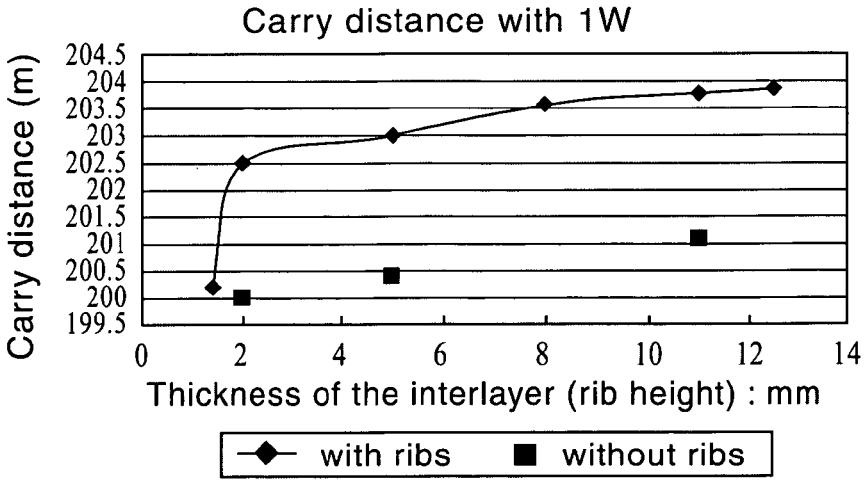
FIG. 24 is a graph showing test results of Examples of the present invention and Comparative Examples.
Figure 24B:
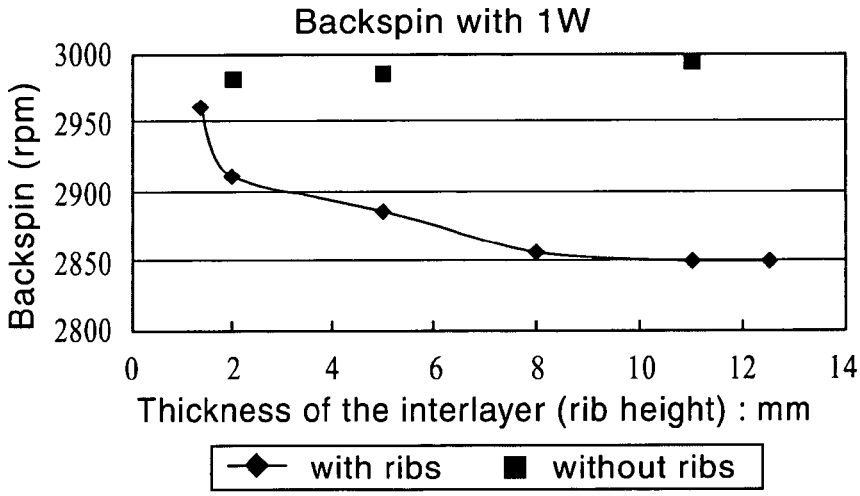
Figure 24C:
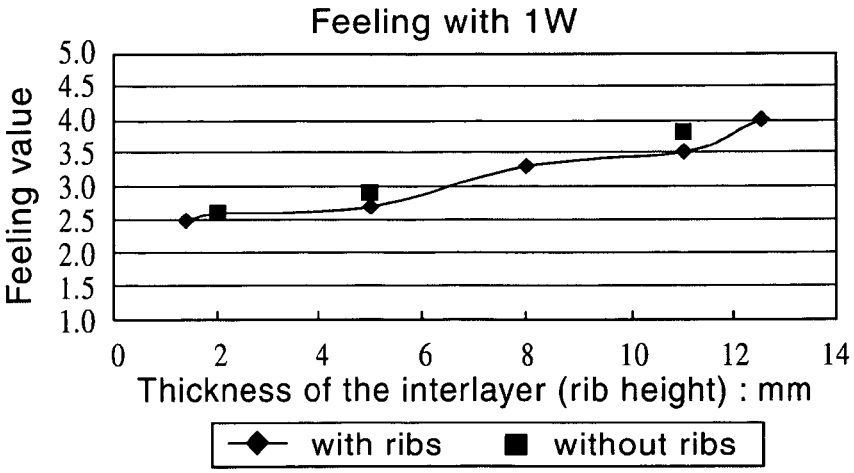

The golf balls of Examples 1, 2 and 4 are compared with those of Comparative Examples 1 to 3 having the same interlayer thickness and the same hardness in each component. As is clear from Table 3, the golf balls of Examples 1, 2 and 4 attained a softer feeling when hit using an iron, and a longer carry distance using a driver. It is assumed that this is because the bounce resilience property of the balls is enhanced due to the interlayer disposed in a depression surrounded by ribs, due to the fact that, as shown in FIG. 24A, the carry distance of a golf ball that is hit with a driver increases as the thickness of the interlayer increases. It is also assumed that the ribs of the present invention reduce spin and increase the carry distance, due to the fact that, as shown in FIG. 24B, the backspin is reduced as the ribs become taller.

Figure 25A:
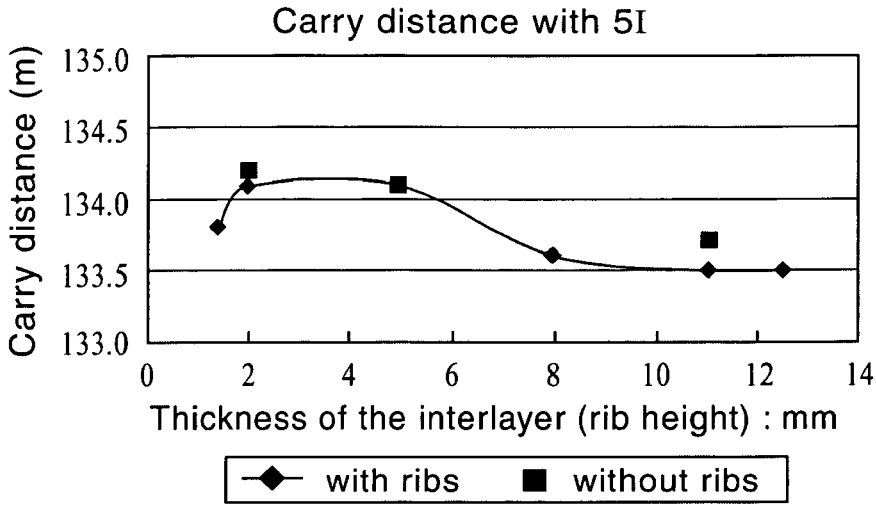
FIG. 25 is another graph showing test results of Examples of the present invention and Comparative Examples.
Figure 25B:
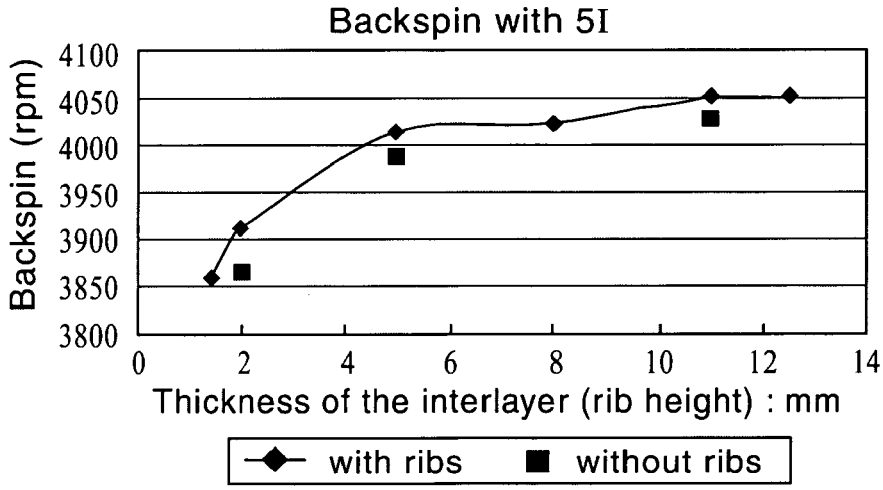
Figure 25C:
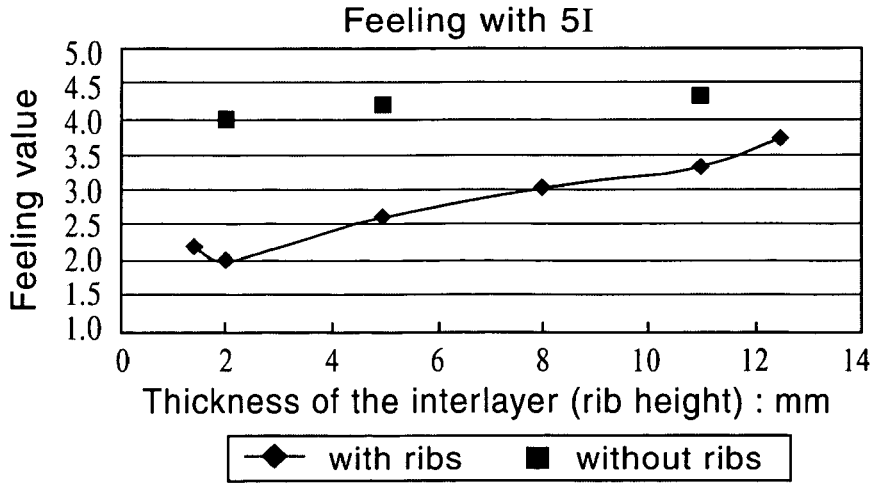

The feeling when the ball was hit using an iron for Examples 1, 2 and 4 are compared with that of Comparative Examples 1 to 3. As shown in FIG. 25C, the feeling when the ball was hit for the golf balls of these Examples is much softer than that of the Comparative Examples which have no ribs. The reason for this is that, when a golf ball is hit with an iron, the ball greatly deforms in the circumferential direction, but in the golf balls of these Examples, the soft ribs absorb the deformation.

From the comparison between Example 5 and Examples 1 to 4, it is clear that when the ribs become shorter than a certain height, the bounce resilience property of the ball is decreased and there is a tendency for the carry distance to exhibit difficulty in increasing because the thickness of the high-hardness interlayer also decreases. In contrast, a comparison of Example 6 and Examples 1 to 4 shows that when the ribs are tall to some degree, the interlayer becomes thicker and this results in a hard feeling when the ball is hit.

In Example 7, the difference in hardness between the core and the interlayer is 11. When the hardness of the interlayer exceeds the hardness of the core to a certain degree, the hardness of the interlayer becomes noticeable and therefore the ball tends to feel hard when hit. In particular, when the ball is hit with an iron whose head speed is relatively slow, it is evaluated as feeling very hard.

In contrast, in Example 8, the difference in hardness between the core and the interlayer is 1. When the difference in hardness is so small, the deformation of the ribs is small and the force opposing the backspin of the ball becomes less. This makes it difficult to obtain a long carry distance.

In Example 9, both the core hardness and the interlayer hardness are high, and therefore the ball feels hard when hit and the longest carry distance was obtained in all Examples and Comparative Examples.

Hereunder, Examples corresponding to the third embodiment of the present invention and Comparative Examples are explained.

TABLE 4

| | Hardness | | |
|---|---|---|---|
| | Main part | Ribs | Interlayer |
| Example 10 | 42 | 46 | 50 |
| Example 11 | 52 | 42 | 46 |
| Example 12 | 46 | 44 | 48 |
| Comparative Example 4 | 52 | Not provided | 44 |

TABLE 5

| | | | | | | |
|---|---|---|---|---|---|---|
| Hardness | 52 | 50 | 48 | 46 | 44 | 42 |
| BR | 100 | 100 | 100 | 100 | 100 | 100 |
| Zinc oxide | 5 | 5 | 5 | 5 | 5 | 5 |
| Barium sulfate | 17 | 17 | 18 | 19 | 19 | 20 |
| Crosslinking initiator | 2 | 2 | 2 | 2 | 2 | 2 |
| Zinc acrylate | 23 | 21 | 19 | 17 | 16 | 14 |
| Magnesium carbonate | 1 | 2 | 2 | 2 | 2 | 2 |
| Antioxidant | 0.1 | 0.1 | 0.1 | 0.1 | 0.1 | 0.1 |

Table 4 shows the hardness (Shore D hardness) of the components composing the golf balls of Examples 10 to 12 and Comparative Example 4. In Examples 10 to 12 and Comparative Example 4, the thickness of the main part composing the core is 23.3 mm, and the thickness of the interlayer is 8 mm. Table 5 shows the compounding ratio of materials for obtaining the hardnesses shown in Table 4. The cover 7 that was used was the same as that of Example 1 (Shore D hardness 62), and other examples.

Example 10 is a golf ball wherein the hardness of the main part 231 of the third embodiment as shown in FIG. 19 is made to be less than that of the ribs 232. Example 11 is a golf ball wherein the hardness of the main part 231 is made to be more than that of the interlayer 5. Example 12 is a golf ball wherein the hardness of the main part 231 is made to be more than that of the ribs 232 and less than that of the interlayer 5. The golf ball obtained in Comparative Example 4 is a conventional three-piece golf ball wherein no ribs are provided on the core, and the core, the interlayer and the cover are concentrically formed.

Using the golf balls obtained in the Examples and Comparative Examples described above, hitting tests were conducted using a hitting robot (manufactured by Miyamae Co., Ltd.: product name "SHOT ROBO V") with a No. 1 Wood (1W: Mizuno Corporation; Mizuno MP-001, loft angle: 9.5°, shaft: Tour Sprit MP carbon shaft (length: 45 inches (114.3 cm), shaft flex: S), and the carry distances were measured. The head speed of the 1W was set at 43.5 m/s, and the ball of each Example and Comparative Example was hit five times. The average carry distance of the five hits was defined as the carry distance for each Example and Comparative Example. Tests of the feeling when the ball was hit were also conducted by ten amateurs using a 1W in the same manner as described above. Table 6 shows the results.

TABLE 6

| | 1W | | | |
|---|---|---|---|---|
| | Carry m | Backspin rpm | Launch angle | Feeling |
| Example 10 | 192.1 | 1914 | 11.6 | 2.8 |
| Example 11 | 190.9 | 2114 | 11.3 | 2.9 |
| Example 12 | 191.4 | 1951 | 11.2 | 2.5 |
| Comparative Example 4 | 184.3 | 2211 | 10.8 | 2.6 |

As is clear from Table 6, compared to the golf ball of Comparative Example 4, the backspin is reduced and the launch angle is increased in each of the golf balls of Examples 10 to 12, obtaining a longer carry distance than that of Comparative Example 4.

As described above, a multi-piece golf ball of the present invention can significantly increase the carry distance.

The invention claimed is:

1. A multi-piece golfball comprising a core, an interlayer, and a cover, wherein the core comprises a spherical main part and three ribs provided on the surface of the main part, each of the three ribs extending along one of three great circles intersecting each other at right angles on the surface of the main part to form eight depressions surrounded by the ribs, the interlayer is inserted into the eight depressions surrounded by the ribs, and the hardness of the interlayer is greater than that of the ribs.

2. The multi-piece golfball according to claim 1, wherein the main part and the ribs are formed into a united body.

3. The multi-piece golfball according to claim 1, wherein the hardness of the main part is the same as that of the ribs.

4. The multi-piece golfball according to claim 1, wherein each of the ribs extends in such a manner that the width thereof becomes greater in the direction from the cover to the core, and each depression is formed into a cone-like shape by the side faces of the ribs.

5. The multi-piece golfball according to claim 1, wherein each of the ribs comprises at least one notch so as to form a passageway between adjacent depressions.

6. A multi-piece golfball comprising a core, an interlayer and a cover, wherein the core comprises a spherical main part and a plurality of ribs provided on the surface of the main part, the interlayer is inserted into depressions surrounded by the ribs, and the hardness of the interlayer is greater than that of the ribs, wherein the hardness of the main part is less than that of the ribs.

7. The multi-piece golfball according to claim 6, wherein each of the ribs extends in such a manner that the width thereof becomes greater in the direction from the cover to the core, and each depression is formed into a cone-like shape by the side faces of the ribs.

8. The multi-piece golfball according to claim 6, wherein each of the ribs comprises at least one notch so as to form a passageway between adjacent depressions.

9. The multi-piece golfball according to claim 6, wherein the ribs are formed along three great circles intersecting each other at right angles on the surface of the main part.

10. A multi-piece golfball comprising a core, an interlayer, and a cover, wherein the core comprises a spherical main part and a plurality of ribs provided on the surface of the main part, the interlayer is inserted into depressions surrounded by the ribs, the hardness of the interlayer is greater than that of the ribs, and the hardness of the main part is greater than that of the interlayer.

11. The multi-piece golfball according to claim 10, wherein each of the ribs extends in such a manner that the width thereof becomes greater in the direction from the cover to the core, and each depression is formed into a cone-like shape by the side faces of the ribs.

12. The multi-piece golfball according to claim 10, wherein each of the ribs comprises at least one notch so as to form a passageway between adjacent depressions.

13. The multi-piece golfball according to claim 10, wherein the ribs are formed along three great circles intersecting each other at right angles on the surface of the main part.

14. A multi-piece golfball comprising a core, an interlayer and a cover, wherein the core comprises a spherical main part and a plurality of ribs provided on the surface of the main part, the interlayer is inserted into depressions surrounded by the ribs, and the hardness of the interlayer is greater than that of the ribs, wherein the hardness of the main part is greater than that of the ribs and less than that of the interlayer.

15. The multi-piece golfball according to claim 14, wherein each of the ribs extends in such a manner that the width thereof becomes greater in the direction from the cover to the core, and each depression is formed into a cone-like shape by the side faces of the ribs.

16. The multi-piece golfball according to claim 14, wherein each of the ribs comprises at least one notch so as to form a passageway between adjacent depressions.

17. The multi-piece golfball according to claim 14, wherein the ribs are formed along three great circles intersecting each other at right angles on the surface of the main part.

18. A multi-piece golfball comprising a core, an interlayer and a cover, wherein the core comprises a spherical main part and a plurality of ribs provided on the surface of the main part, the interlayer is inserted into depressions surrounded by the ribs, and the hardness of the interlayer is greater than that of the ribs, wherein the ribs extend along three great circles intersecting each other at right angles on the surface of the core, and each of the ribs comprises at least one notch so as to form a passageway between adjacent depressions, an arc section on each of the ribs partitioned by the intersections of the great circles is provided with at least one notch, each notch has a plane extending along the arc section from one point on a line that is normal to the core and that passes through the intersection of the great circle, and the plane has an angle that is not smaller than 90. degree. relative to the normal line.

19. A multi-piece golfball comprising a core, an interlayer and a cover, wherein the core comprises a spherical main part and a plurality of ribs provided on the surface of the main part, the interlayer is inserted into depressions surrounded by the ribs, and the hardness of the interlayer is greater than that of the ribs, wherein the ribs extend along three great circles intersecting each other at right angles on the surface of the core, and each of the ribs comprises at least one notch so as to form a passageway between adjacent depressions, an arc section on each of the ribs partitioned by the intersections of the great circles is provided with at least one notch, the notch is formed in the middle of each arc section in the arc direction, and each notch has two planes, both extending toward the intersection from one point of a line that is normal to a spherical body that passes through the mid point of each arc section in the arc direction, wherein the angle made between the plane and the normal line is 45 to 48°.

20. A method for manufacturing a multi-piece golfball comprising a core, an interlayer, and a cover, comprising:

preparing a first mold that comprises a cavity provided with a base having a spherical surface, and a plurality of grooves formed along the surface of the base and having substantially the same depth as each other as measured from the surface; molding a core having a plurality of ribs on the surface of a spherical main part by inserting a core material into the cavity of the first mold;

preparing a second mold having a spherical cavity corresponding to the outermost diameter of the core; molding an interlayer whose hardness is greater than that of the core by placing the core taken from the first mold into the cavity of the second mold, and then inserting an interlayer material into depressions surrounded by the ribs; and molding a cover onto the second interlayer.

21. A method for manufacturing a multi-piece golfball according to claim 20, wherein the cavity of the first mold is structured so that the plurality of grooves communicate with one another to form at least one closed region, and wherein at least one shallower portion is formed in the grooves.

22. A method for manufacturing a multi-piece golfball comprising a core, an interlayer, and a cover, comprising:

molding a spherical main part; preparing a first mold comprising a cavity provided with a spherical receiving part corresponding to the surface of the main part, and a plurality of grooves formed along the surface of the receiving part and having substantially the same depth as each other as measured from the surface;

molding the core having a plurality of ribs on the surface of the main part by placing the main part in the receiving part of the first mold and inserting a material having a hardness different from that of the main part into the cavity;

preparing a second mold having a spherical cavity corresponding to the outermost diameter of the first interlayer;

molding an interlayer whose hardness is greater than that of the core by placing the core taken from the first mold in the cavity of the second mold, and then inserting a material having a hardness different from that of the ribs into depressions surrounded by the ribs; and molding a cover onto the interlayer.

23. A method for manufacturing a multi-piece golfball according to claim 22, wherein the cavity of the first mold is structured so that the plurality of grooves communicate with one another to form at least one closed region, and wherein at least one shallower portion is formed in the grooves.

* * * * *